US006170380B1

(12) United States Patent
Bender-Zanoni et al.

(10) Patent No.: US 6,170,380 B1
(45) Date of Patent: Jan. 9, 2001

(54) METHOD AND APPARATUS FOR STORING AND HANDLING PROPELLANT CHARGE UNITS

(75) Inventors: Joseph F. Bender-Zanoni, Ann Arbor, MI (US); Anthony R. Steward, Essex Junction, VT (US); Ned S. Ashton, Plymouth, MN (US); Derek A. Rodriguez, South Hero, VT (US); Glenn P. Livingston, Ellicott City, MD (US)

(73) Assignee: General Dynamics Armament Sys., Inc., Burlington, VT (US)

( * ) Notice: Under 35 U.S.C. 154(b), the term of this patent shall be extended for 0 days.

(21) Appl. No.: 09/453,412

(22) Filed: Dec. 3, 1999

Related U.S. Application Data

(60) Provisional application No. 60/114,463, filed on Dec. 30, 1998.

(51) Int. Cl.[7] ..... F41A 9/00

(52) U.S. Cl. ..... 89/45; 89/33.04

(58) Field of Search ..... 89/45, 33.04; 221/123, 221/258, 87, 88; 198/347.2, 347.4, 468.6; 414/280

(56) References Cited

U.S. PATENT DOCUMENTS 3,719,288 * 3/1973 Schmitt ..... 214/16.4
4,824,311 * 4/1989 Mims ..... 414/273
5,111,730 * 5/1992 Grabner ..... 89/45
5,212,338 * 5/1993 Maher ..... 89/45
5,277,540 * 1/1994 Helms ..... 414/751
5,458,044 * 10/1995 Delbos ..... 89/33.1
5,837,923 * 11/1998 Gay ..... 89/46

* cited by examiner

*Primary Examiner*—Jack W. Lavinder
(74) *Attorney, Agent, or Firm*—Finnegan, Henderson, Farabow, Garrett & Dunner

(57) ABSTRACT

A system and method for selectively transferring storable units, particularly artillery propellant charge units, between a storage space and a location outside of the storage space, the system including a storage magazine having a plurality of parallel, axially elongated chambers opening at an end of the storage magazine, a shuttle having a transfer mechanism tube movable relative to the storage magazine between positions of axial alignment with each of the plurality of elongated chambers and the location outside of the storage space, and a feed mechanism to move the units between the transfer tube and the elongated chambers. Where the elongated chambers are respectively centered on Z axes with open ends presented at intersecting X and Y axes perpendicular to the Z axes, the shuttle is translatable in an X direction and supports the transfer tube on a Z-axis for movement in a Y direction relative to the storage magazine so that a combination of shuttle translation on the X axis and movement of the transfer tube on the Y axis positions the transfer tube in axial alignment with the respective open ends of each of the plurality of cylindrical tubes. The feed mechanism moves the charge units in the Z direction between the respective elongated chambers and the transfer tube. A conveyor aligned with a Z axis delivers charge units to and from the storage magazine and is positioned for transfer of charge units to and from the shuttle mounted transfer tube.

21 Claims, 21 Drawing Sheets

METHOD AND APPARATUS FOR STORING AND HANDLING PROPELLANT CHARGE UNITS

CROSS REFERENCE TO RELATED APPLICATIONS

This application claims priority under 35 U.S.C. § 119 based on U.S. Provisional application Ser. No. 06/114,463, filed Dec. 30, 1998, the disclosure of which is hereby incorporated by reference.

GOVERNMENT CONTRACT

Department of Defense/U.S. Army, Contract Number—DAA30-95-C-0009.

BACKGROUND OF THE INVENTION

1. Field of the Invention

This invention relates to a method and apparatus for selectively transferring storable units between a storage space and a location outside of the storage space, and, more particularly to such a method and apparatus for storing and handling artillery propellant charge units.

2. Description of the Related Art

The planned introduction of advanced artillery systems calls for the use of a fully automated ammunition handling capability including the storage of propellant charge units. The propellant charge units are molded, combustible containers filled with either ball or stick propellant and referred to as Modular Artillery Charge Systems (MACS). These propellant charge units or modules are illustrated and described in commonly assigned U.S. application Ser. No. 09/144,623, filed Aug. 31, 1998, the disclosure of which is hereby incorporated by reference.

In operating large caliber guns such as self propelled field howitzers, naval guns and fixed gun emplacements, a selective number of the individual propellant charge units would be used, depending upon the type of projectile, range, etc. required. The MACS transfer mechanism then ideally must be able to selectively transfer into or access from a storage magazine, a single charge, or multiple charges. Because the MACS use combustible, nitrocellulose based, charge containers having the external form of right circular cylinders and have handling and strength characteristics similar to cardboard, but which is highly combustible, they present unique problems to automated handling and storage with the space constraints existing in the place of their application.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention is directed to an apparatus for selectively transferring storable units between a storage space and a location outside of the storage space, comprising a storage magazine including a plurality of parallel, axially elongated chambers opening through at least one end of the storage magazine, a shuttle having a transfer tube movable relative to the storage magazine between positions of axial alignment with each of the plurality of elongated chambers and the location outside of the storage space, and a feed mechanism to move the units between the transfer tube and the elongated chambers.

In another aspect, the advantages and purpose of the invention are obtained by a system for storing and handling artillery propellant charge units, comprising a storage magazine including a plurality of parallel, cylindrical tubes defining elongated chambers respectively centered on Z axes and having open ends presented at intersecting X and Y axes at one end of the storage magazine, the X and Y axes being perpendicular to the Z axes. A shuttle is translatable on an X axis along the one end of the storage magazine and supports a transfer tube parallel to the cylindrical tubes and movable on a Y axis relative to the storage magazine so that a combination of shuttle translation on the X axis, and movement of the transfer tube on the Y axis, positions the transfer tube in axial alignment with the respective open ends of each of the plurality of cylindrical tubes. A feed mechanism moves the charge units on the Z axes between the respective elongated chambers and the transfer tube. A conveyor aligned with a Z axis delivers charge units to and from the storage magazine and is positioned for transfer of charge units to and from the shuttle mounted transfer tube.

In still another aspect, the advantages and purpose of the invention are obtained by a method for storing artillery charge units in a storage magazine including a plurality of parallel, elongated, cylindrical chambers respectively centered on Z axes and having open ends presented at intersecting X and Y axes at one end of the storage magazine, the X and Y axes being perpendicular to the Z axes, using a shuttle translatable on an X axis along the one end of the storage magazine and supporting a transfer tube parallel to the Z axes and movable on a Y axis. The method comprises the steps of loading the charge units into the transfer tube on one side of the magazine, translating the shuttle on the X axis to a position of registration with an X axis of one of the storage chambers, moving the transfer tube on the Y axis to a position of registration with the Z axis of the one of the storage chambers, and advancing the charge units along the Z axis of and into the one of the storage chambers.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DESCRIPTION OF THE PREFERRED EMBODIMENT

Reference will now be made in detail to the present preferred embodiment of the invention, an example of which is illustrated in the accompanying drawings. Wherever possible, the same reference numbers will be used throughout the drawings to refer to the same or like parts.

In accordance with the present invention, an apparatus for selectively transferring storable units between a storage space and a location outside of the storage space is provided. Although the apparatus is particularly adapted to a system for storing and handling artillery propellant charge units in military applications, it is useful in other applications where storage units are to be loaded and unloaded to and from a magazine-type storage facility. The apparatus generally includes a storage magazine including a plurality of parallel, axially elongated chambers opening at an end of the storage magazine, a shuttle having a transfer mechanism movable relative to the storage magazine between positions of axial alignment with each of the plurality of elongated chambers and the location outside of the storage space, and a feed mechanism to move the units between the transfer tube and the elongated chambers. For purposes of directional reference in the ensuing description and in the appended claims, an X, Y and Z system of axes will be used in which all Z axes are parallel to each other, all X axes are parallel to each other, all Y axes are parallel to each other, the Z axes are perpendicular to both the X and Y axes, and the X and Y axes intersect each other at an acute angle.

Figure 1:
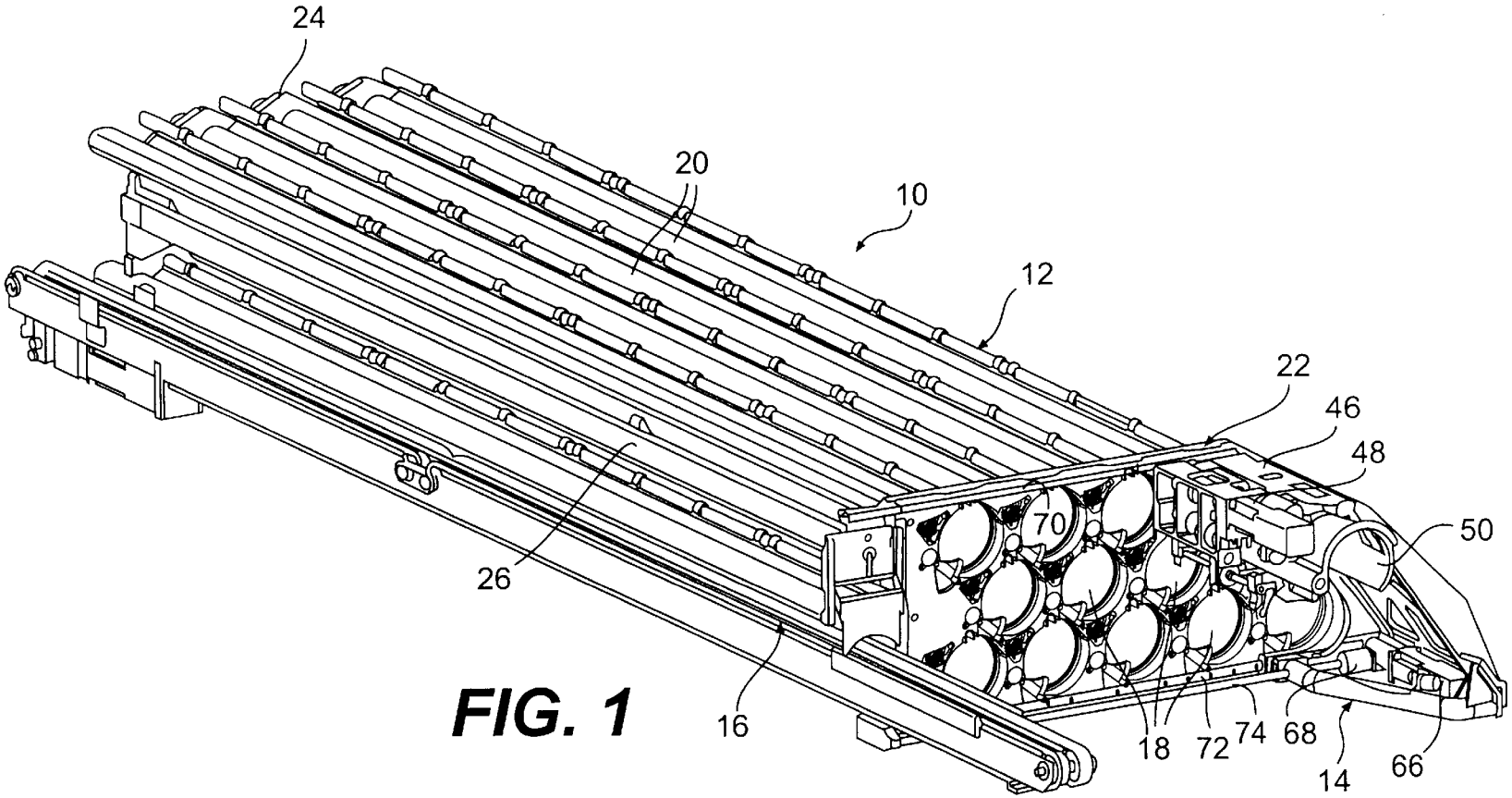
FIG. 1 is a perspective view illustrating a preferred embodiment of the unit storage and handling apparatus of the invention.

In FIG. 1, a preferred embodiment of the complete system of the present invention is generally designated by the reference numeral 10, and shown to include a storage magazine 12, a shuttle 14 translatable along the front end of the magazine 12, and a conveyor 16 positioned along one side of the magazine 12. The magazine 12 is shown most clearly in FIGS. 2 and 3 as including a plurality of elongated, preferably cylindrical storage chambers 18 defined by parallel tubes 20 supported at front ends that open through a front frame member 22. The tubes 20 are supported at their rear ends by a rear frame member 24 connected to the front frame member 22 by longitudinal rails 26 and by the tubes 20, themselves.

Figure 2:
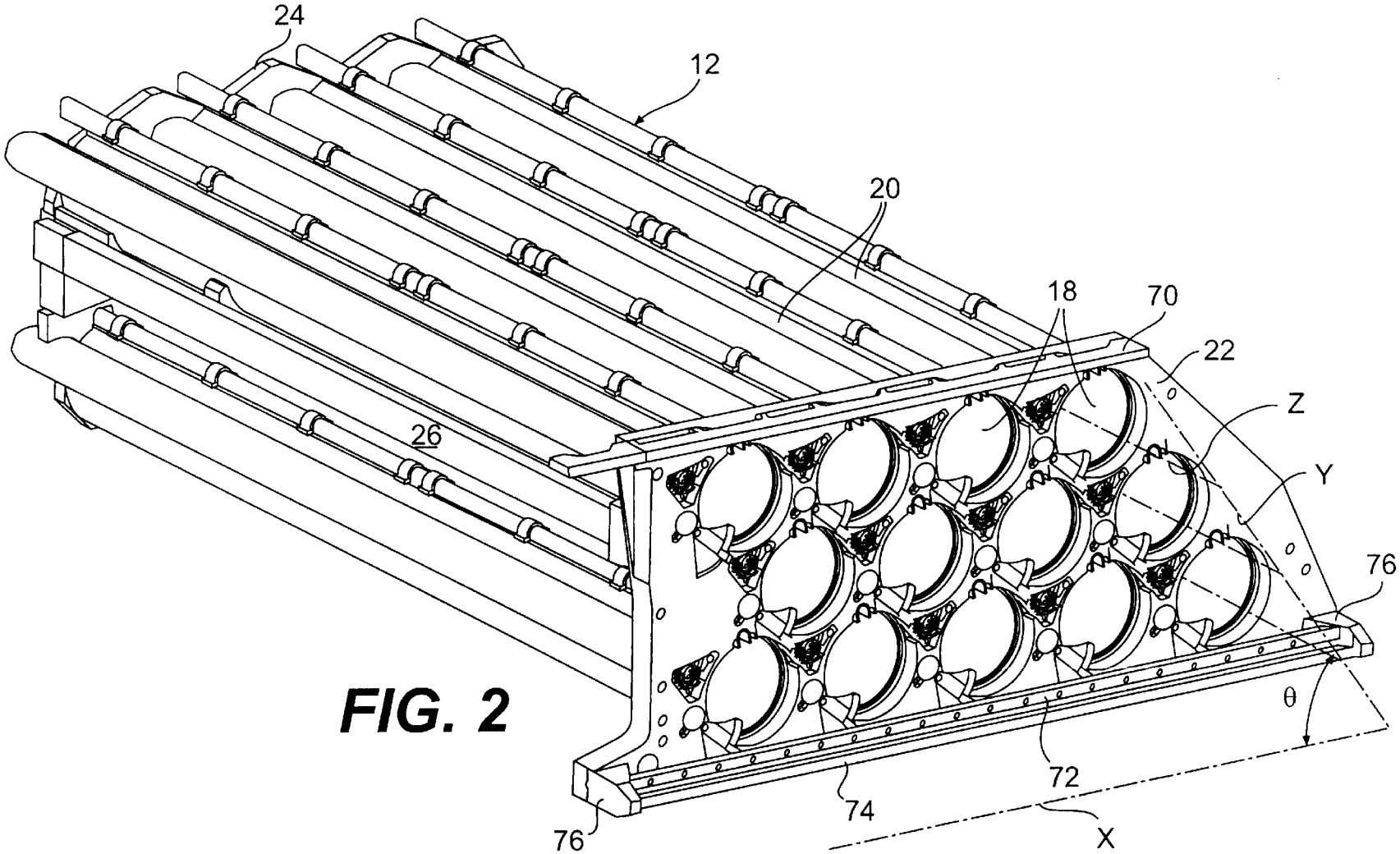
FIG. 2 is a perspective view illustrating a storage magazine of the apparatus shown in FIG. 1.

As depicted in FIG. 2, the tubes 20 are centered on Z axes that are perpendicular to X and Y axes, the latter intersecting each other by an angle θ. The angle θ between the X and Y axes is preferably an acute angle in the range of from about 45° to 90°, and more preferably in the range of from 50° to 60° to provide optimal space efficiency, given the circular cross section of the tubes 20, but other angles between the X and Y axes may be used.

In accordance with the invention, each of the plurality of parallel, axially elongated chambers includes a self-energized friction restraint for preventing movement of units stored in each chamber toward the open end thereof. Preferably the self-energized friction restraint includes a friction pad extending axially along one side of each chamber, and a cam system for developing a radial normal force on the friction pad in response to an axial force tending to move the stored units toward the open end of the respective chambers.

Figure 4:
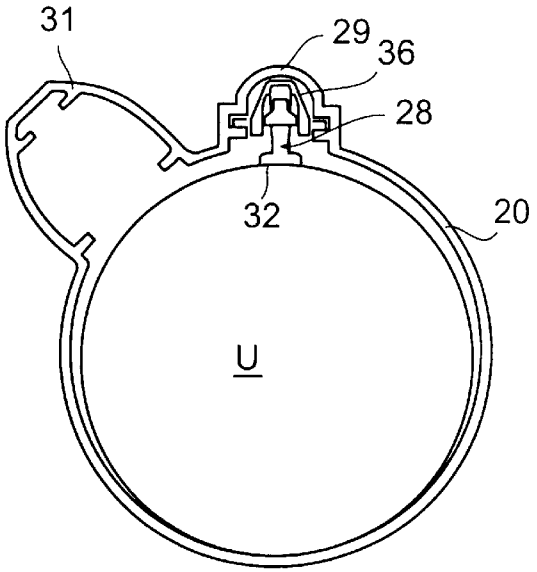
FIG. 4 is an end view of a storage chamber incorporated in the storage magazine of FIG. 2.
Figure 5:
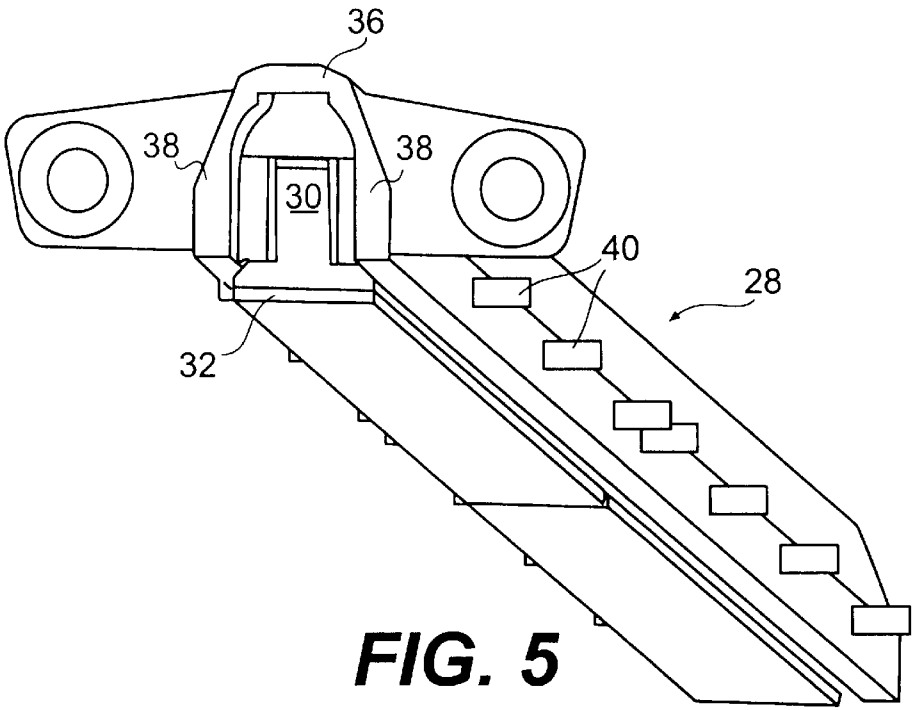
FIG. 5 is a perspective view illustrating a frictional restraint used in the tube shown in FIG. 4.

In the illustrated embodiment, and as shown in FIGS. 4 and 5, cylindrical units U stored within the tubes 20 are engaged radially by a frictional restraint designated generally by the reference numeral 28, preferably located in a channel-shaped formation 29 at the top of each tube 20. Each of the storage tubes also includes a feed screw housing formation 31 to be described in more detail hereinafter.

Figures 6, 7:
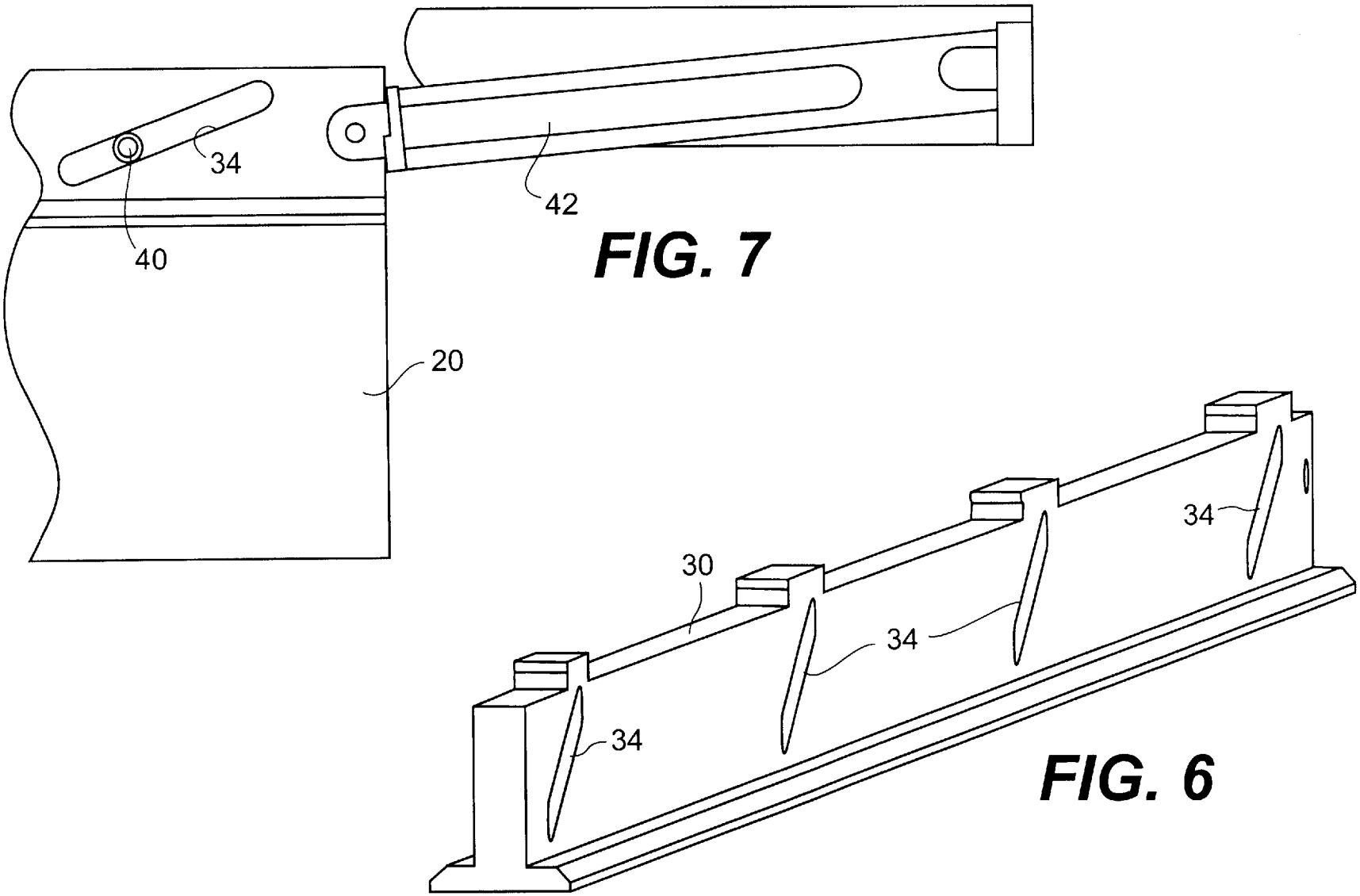
FIG. 6 is a perspective view illustrating a component used in the restraint device of FIG. 5.
FIG. 7 is a fragmentary side elevation illustrating the bias mechanism used with the frictional restraint of FIG. 5.

As shown in FIGS. 5 and 6, the restraint includes a plurality of axially aligned inverted T-shaped bars 30, each supporting a downwardly facing friction pad 32 and having a plurality of commonly inclined slots 34 in the vertical webs thereof. The vertical webs of the inverted T-shaped bars are received in a downwardly opening channel member 36 having side flanges 38, the channel member 36 being fixed to or integrated with the top portion of the tube 20. Pins 40 extend through the inclined slots 34 and are fixed in the side flanges 38 of the channel member 36.

The rearward-most bar 30 in each tube 20 is biased toward the front end of the tube by a compression spring assembly 42 shown in FIG. 7. By virtue of the axially abutting relationship of the several bars 30 and the common inclination of the slots 34, the bias of the spring assembly 42 will cause a downward normal force urging the friction pads 32 against the units U. Moreover, any force tending to move the units U toward the open front ends of the tubes 20 will result in an increased normal force retaining the units U against such movement. Release of the self-energized restraints 28 to permit removal of the units U from a tube 20 requires a force capable of advancing the bars 30 rearwardly against the bias of the spring assembly 42, and will be described in more detail below.

Figure 8:
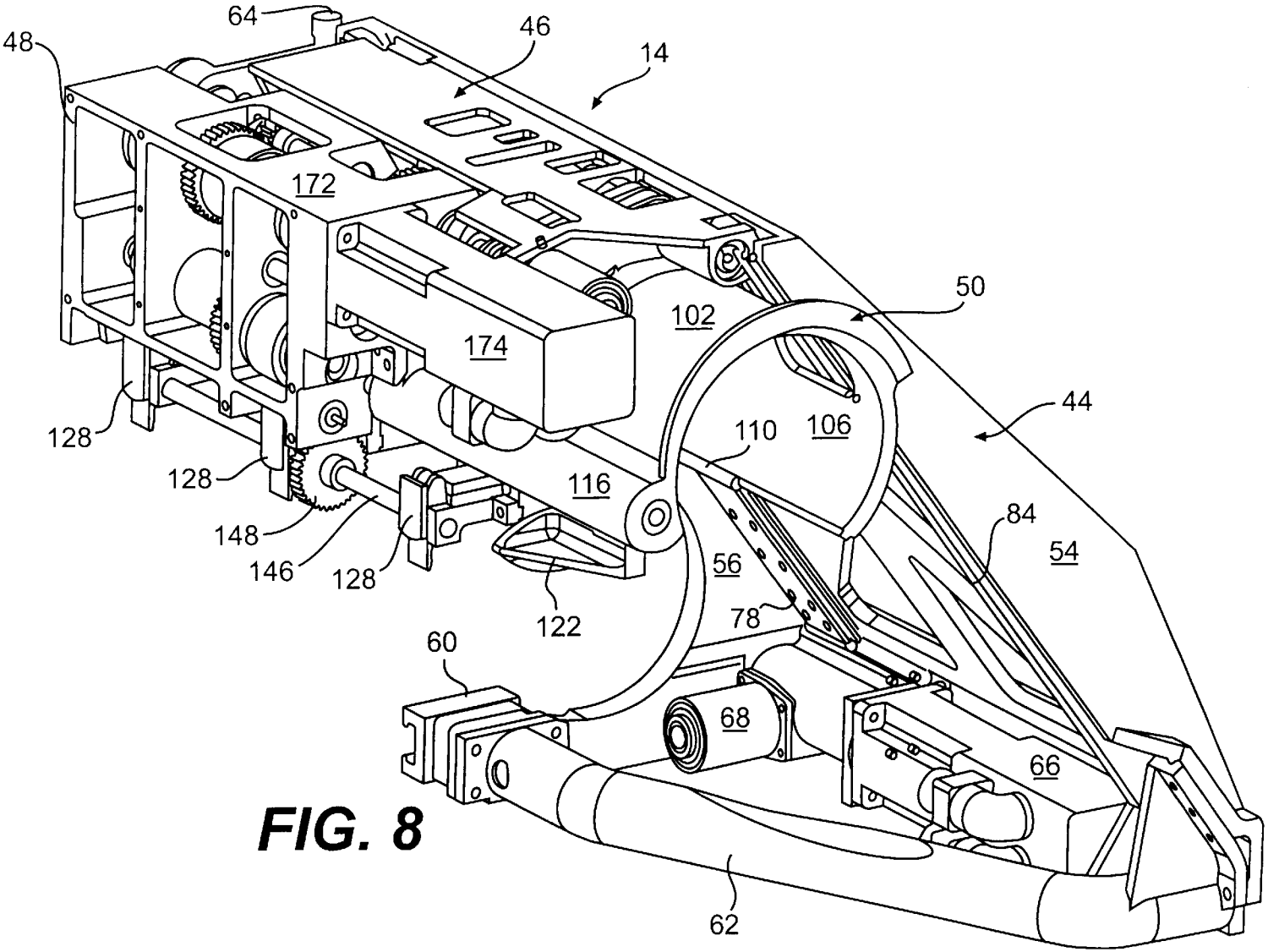
FIG. 8 is a perspective view illustrating an assembled shuttle used in the system of FIG. 1.

A complete assembly of the shuttle 14, in the illustrated embodiment, is shown in FIG. 8 of the drawings. The shuttle 14 includes as subassemblies, a shuttle carriage 44 shown separately in FIG. 9, an elevator slide 46 shown separately in FIG. 10, a motor powered drive train 48 shown separately in FIG. 11, and a transfer tube 50 shown separately in FIG. 12.

Figure 9:
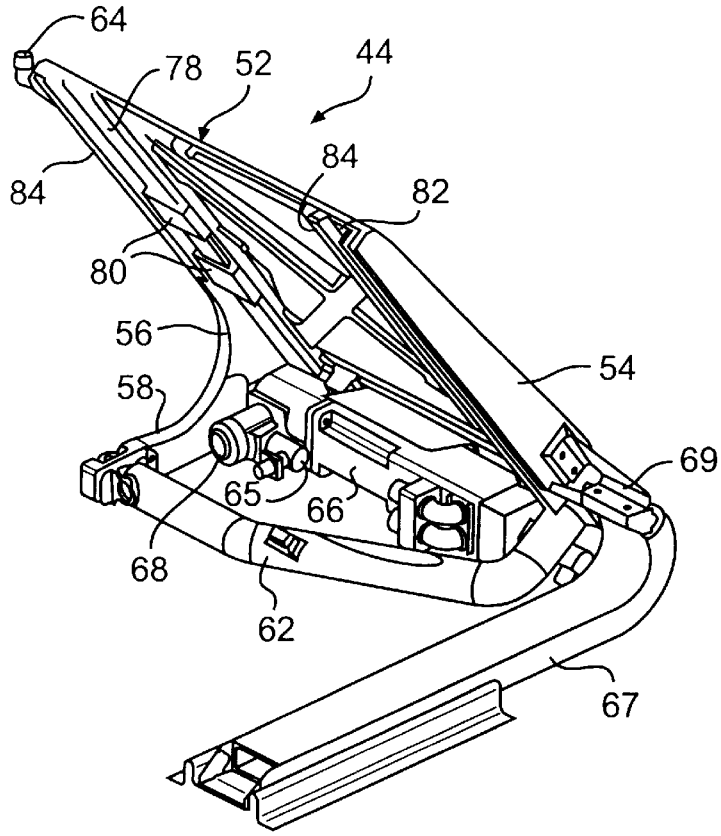
FIG. 9 is a perspective view illustrating a shuttle carriage component of the device illustrated in FIG. 8.

As shown in FIGS. 8 and 9, the shuttle carriage 44 includes an inclined integrated frame 52 having front and rear beams 54 and 56, the rear beam 56 joining with a horizontal leg 58 supporting a channel shaped slide bracket 60 at its end. A strut 62 connects the end of the horizontal leg 58 with the bottom of the front beam and a support cam 64 is mounted at the top end of the rear beam 56. A reversible translating motor 66 is supported on the frame 52 between the lower ends of the inclined front and rear beams 54 and 56 and drives a rotatable screw nut 68 positioned near the rear end of the frame 52. A brake unit 65 is associated with the screw nut 68 to lock the screw nut against rotation. Also a power and signal cable conduit 67 is secured to the front beam 54 by a bracket 69.

Figure 3:
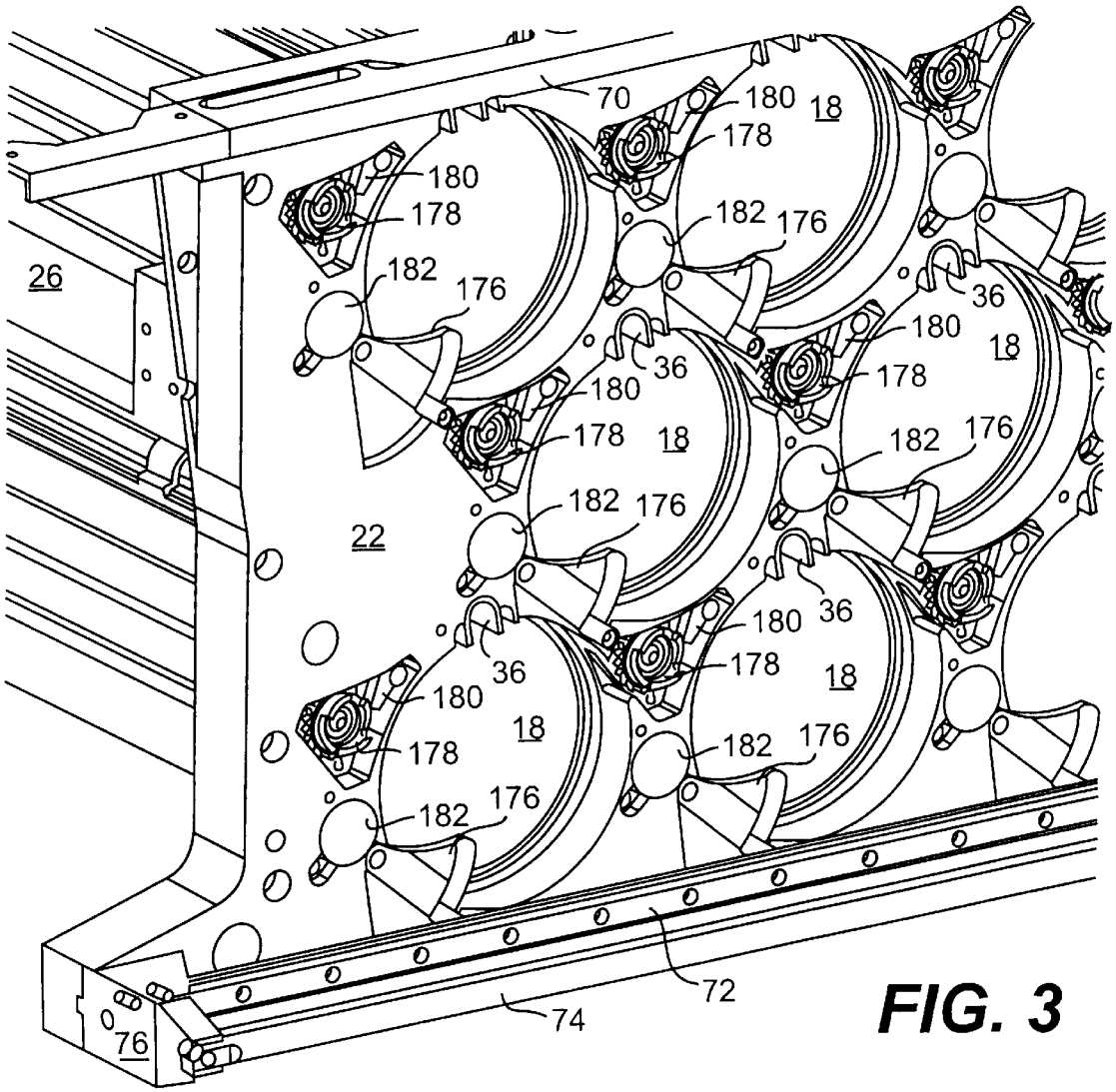
FIG. 3 is an enlarged fragmentary perspective view illustrating the front end of the storage magazine shown in FIG. 2.

As shown in FIGS. 2 and 3, the front frame member 22 of the storage magazine 12 supports a downwardly opening top rail 70 and a bottom linear ball slide rail 72. A fixed lead screw 74 is supported by brackets 76 to be spaced forward of the slide rail 72. As shown in FIG. 1, and as will be appreciated from the described and illustrated arrangement of the top and bottom rails 70 and 72 on the front frame member 22 of the magazine 12, the shuttle carriage 44 may be mounted on the front frame member 22 for translating movement by engagement of the support cam 64 with the top rail 70 and of the slide bracket 60 with the ball slide rail 72. Moreover, when so mounted with the screw nut 68 engaged with the fixed lead screw 74, the reversible translating motor 66 may operate to move the shuttle carriage back and forth on an X axis relative to the storage magazine 12.

The inclined frame 52 of the shuttle carriage 44 supports on its underside, a Y-linear ball slide 78, on which a pair of brackets 80 are slidable. A Y-cam track 82 is supported on the inner side of the front beam 54 to be parallel with the ball slide 78. A pair of racks 84, also parallel with the ball slide 78, are supported adjacent the front and rear beams 54 and 56.

Figure 10:
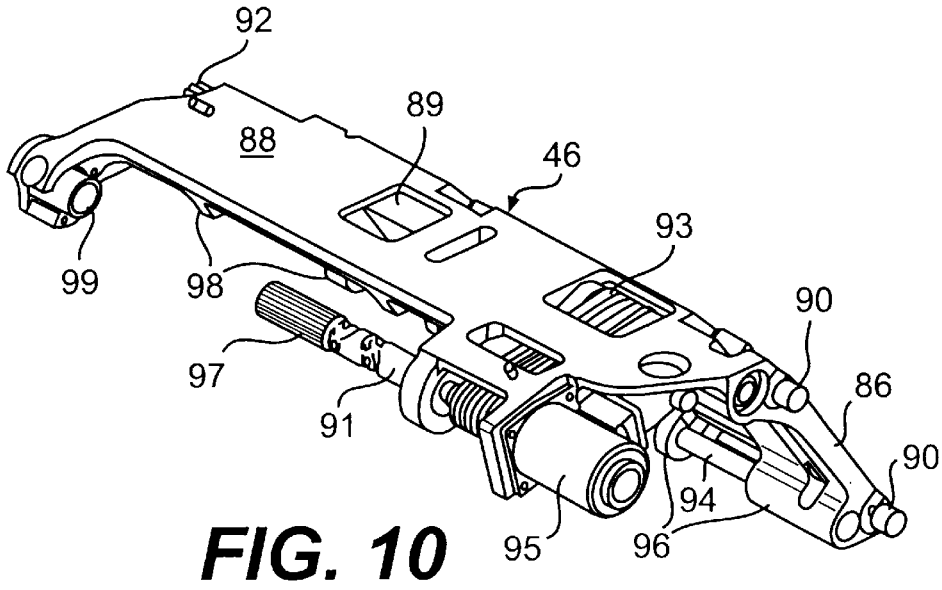
FIG. 10 is a perspective view illustrating an elevator slide incorporated in the shuttle of FIG. 8.

As shown in FIGS. 8 and 10, the elevator slide 46 includes an inclined carriage portion 86 that joins at its upper edge with a horizontal support portion 88. A pair of cam rollers 90 project from the front end of the carriage portion 86 to engage in the Y-cam track 82 on the shuttle carriage 44. The back of the elevator slide carriage portion is bolted to brackets 80 on the Y-linear ball slide 78 of the shuttle carriage 44. Also, a pair of pinion gears 92 are fixed to a gear shaft 89 journalled in the elevator slide 46 to be presented at the front and rear ends of the elevator slide 46 in positions to mesh with the respective racks 84, only one of the pinion gears 92 being visible in FIG. 10. The gear shaft 89 is coupled with a drive shaft 91 on the distal edge of the horizontal support portion 88 by endless drive chains 93. A Y-axis brake 95 is fitted to one end of the drive shaft 91 whereas a universal joint and spline 97 are provided on the other end of the drive shaft 91 for connection to the motor powered drive train 48 in a manner to be described in more detail below. A lead screw nut 99 is fitted to the rear end of the distal edge of the horizontal support portion 88 to receive a Z-axis lead screw of the motor powered drive train 48 also to be described below. It will be apparent from this description that the elevator slide 46 is mountable on the shuttle carriage 44 for up and down movement on a Y-axis by rotation of the pinion gears 92.

Figure 12:
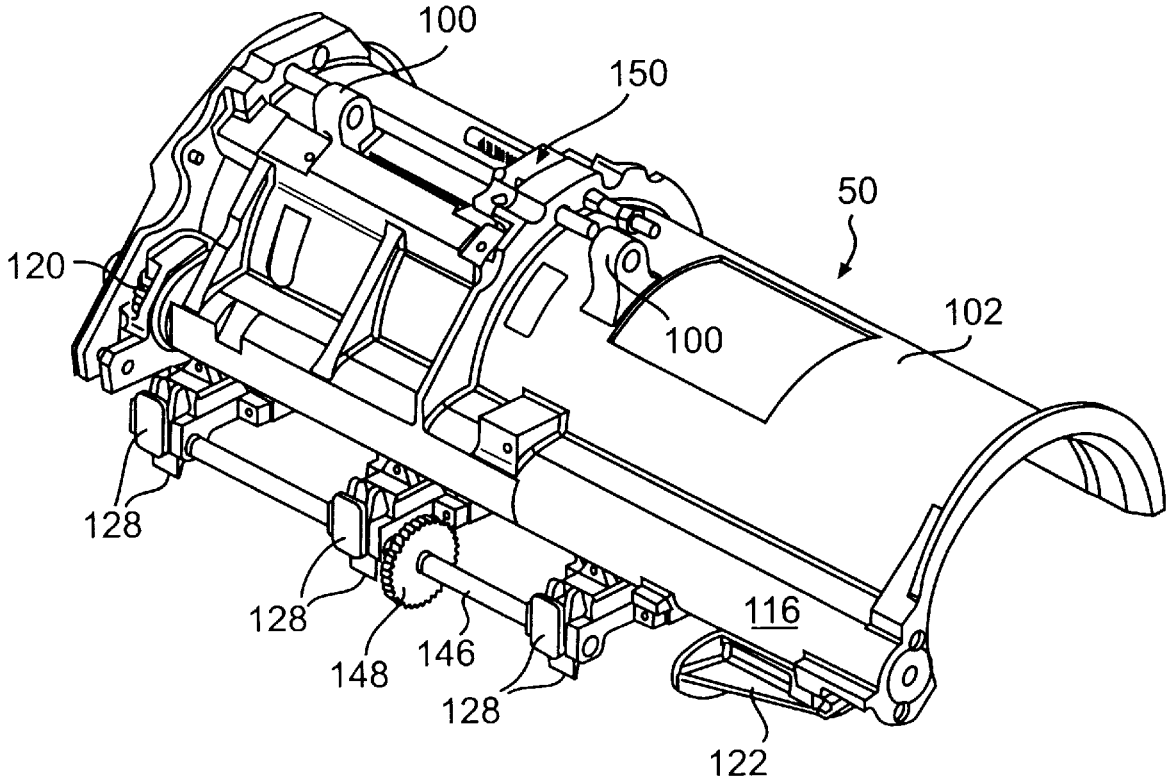
FIG. 12 is a perspective view showing one side of a transfer tube carried by the shuttle of FIG. 8.

The carriage portion 86 of the elevator slide 46 includes an elongated attachment pin 94 supported along its length by spaced bosses 96. A second attachment pin (not shown) is supported by depending bosses 98 spaced along the distal edge of the horizontal support portion 88 and shown in FIG. 10. The transfer tube 50, as shown in FIG. 12, includes a pair of upstanding bearing lugs 100 of an axial length shorter than the spacing between the depending bosses 98. The bearing lugs 100 receive the second attachment pin (not shown) supported by the depending bosses 98. Additional bearing lugs (not shown), also of an axial length shorter than the spacing between the bosses 96, receive the attachment pin 94. In this manner, the transfer tube 50 is supported by the elevator slide for limited translational movement on a Z axis relative to the elevator slide 46 and the shuttle carriage 44. Moreover, the motor powered drive train 48 is bolted to the transfer tube 50, and is therefore movable as a unit with the transfer tube 50 relative to the elevator slide 46.

Figure 13:
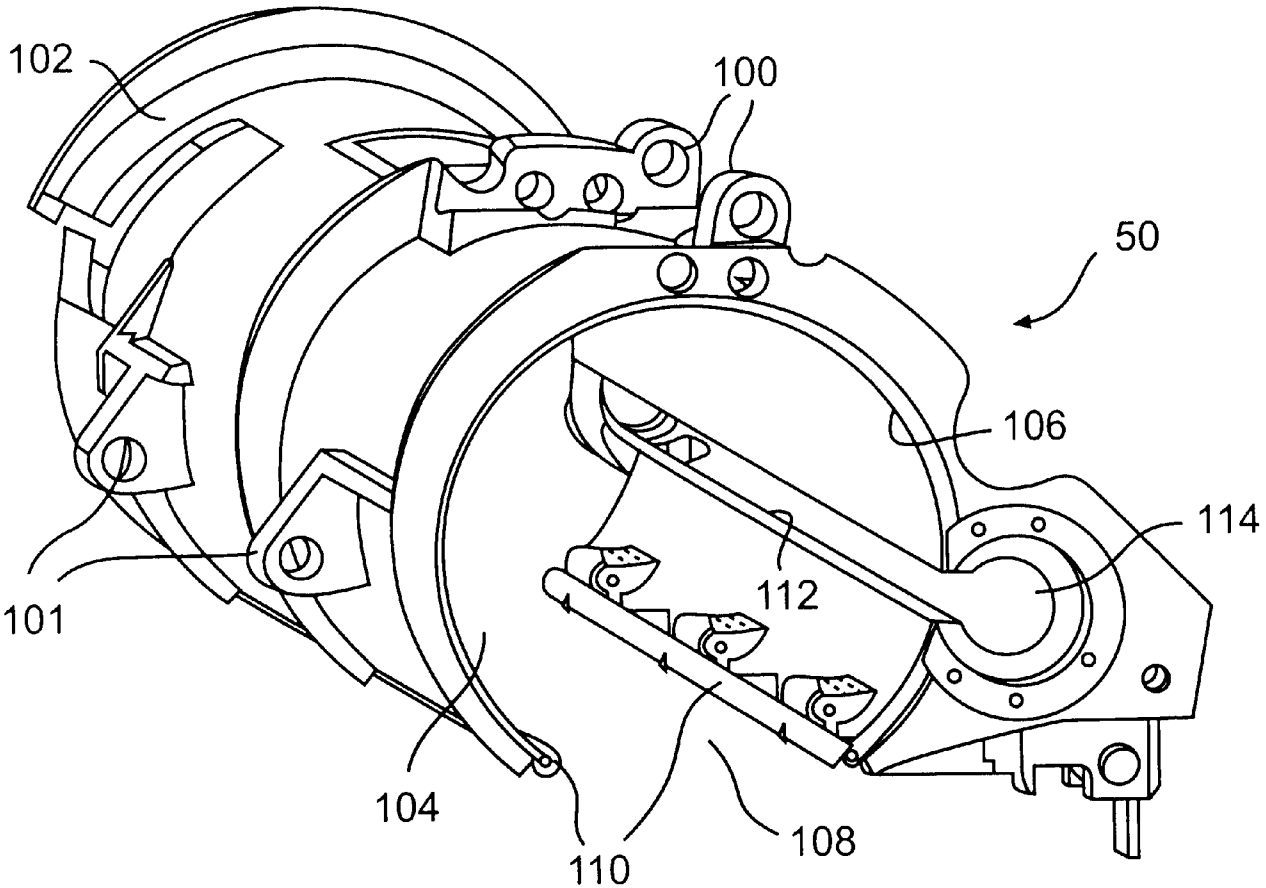
FIG. 13 is a perspective view illustrating the opposite side of the transfer tube shown in FIG. 12.
Figure 14:
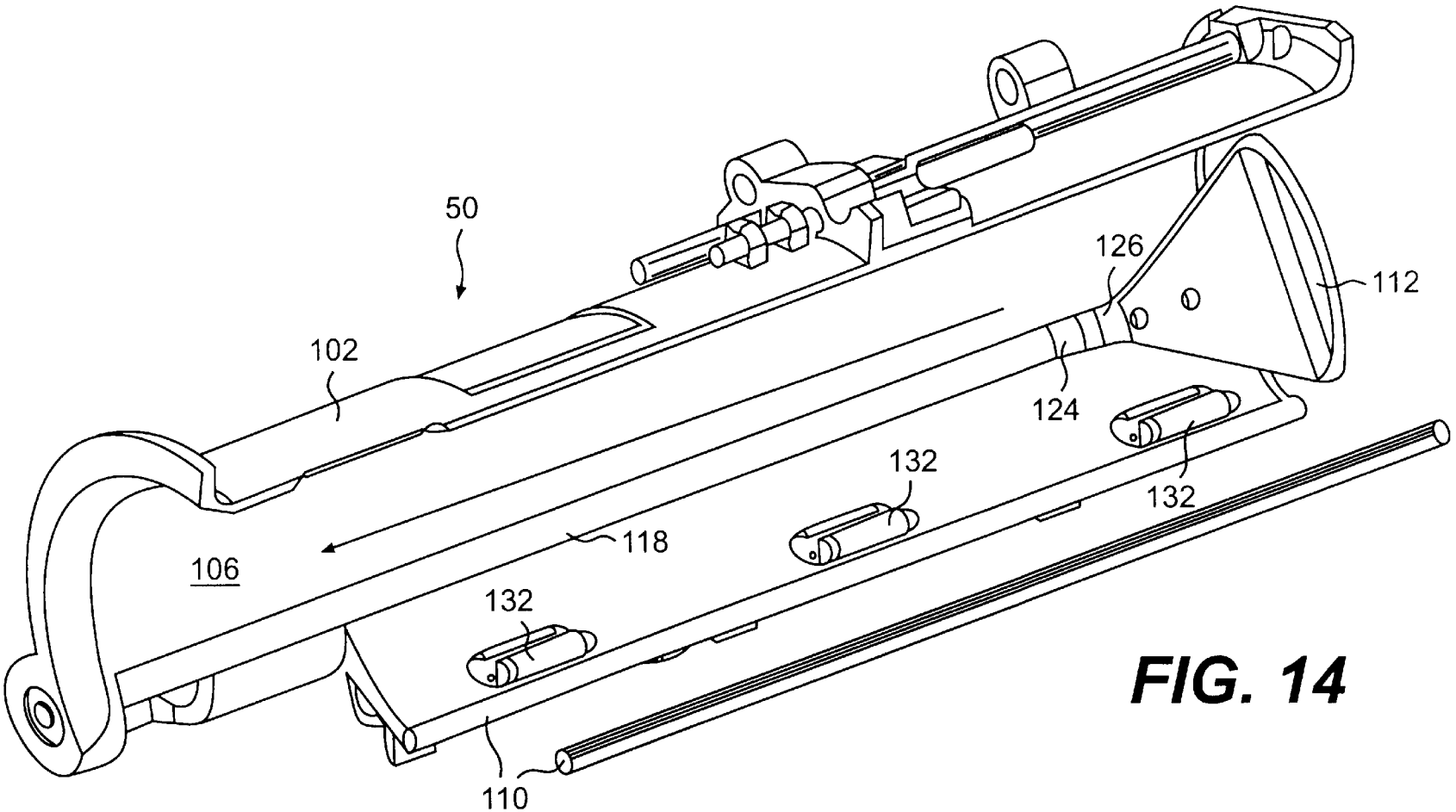
FIG. 14 is a cut-away perspective view illustrating the interior of the transfer tube shown in FIGS. 12 and 13.
Figure 15:
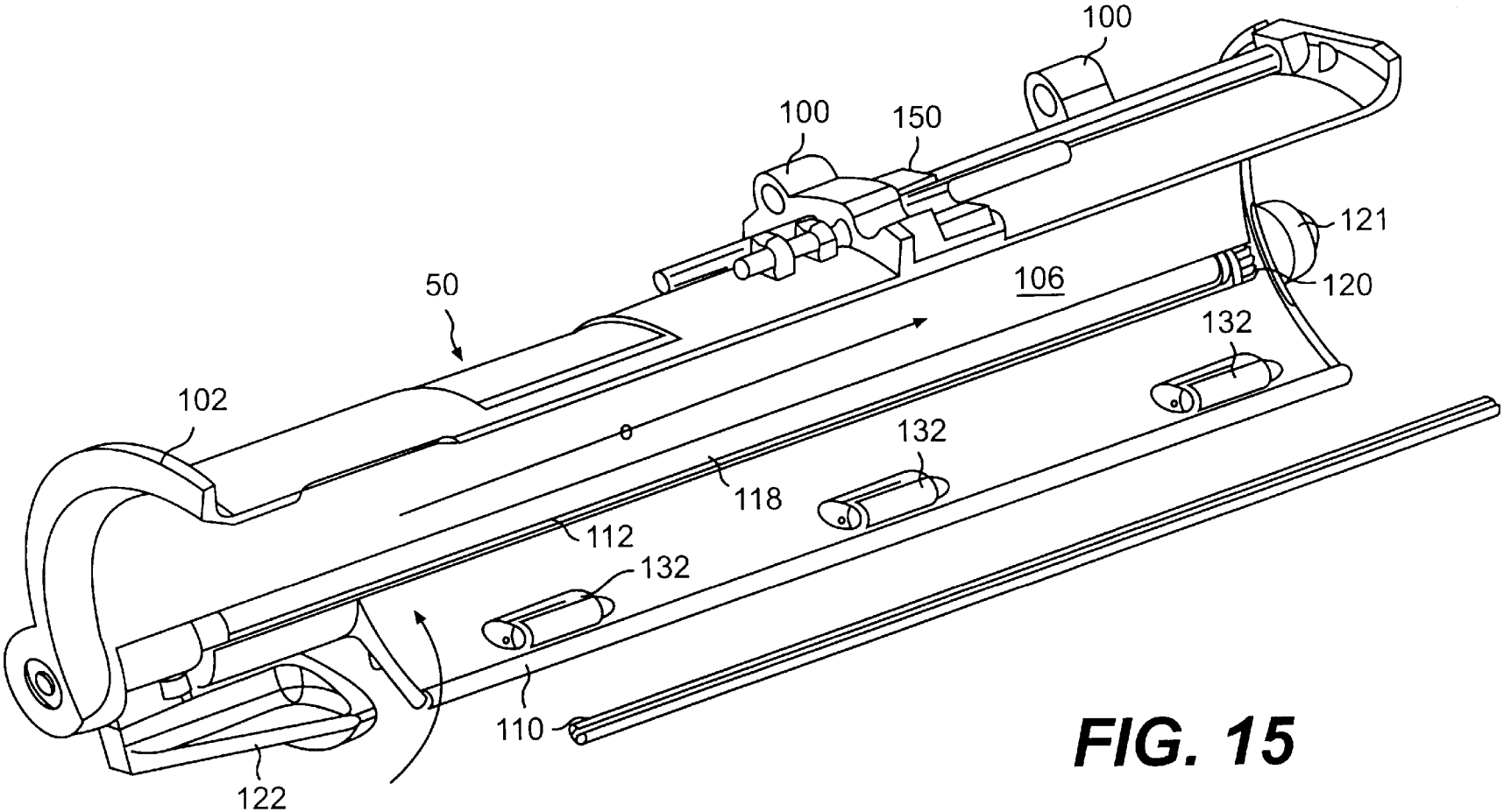
FIG. 15 is a cut-away perspective view similar to FIG. 14 but illustrating components in a different operating condition.

A complete understanding of the transfer tube 50 of the illustrated embodiment and of operating components associated with the transfer tube may be had by reference to FIGS. 12–18 of the drawings. As shown in FIGS. 12 and 13, the transfer tube includes a cast or molded outer housing 102 and an internal cylindrical passageway 104 that is open at both ends. The passageway 104 is defined by a cylindrical tube segment 106 having an axial bottom opening 108 delineated by slide rails 110 on opposite sides. The tube segment 106 is formed along one side with a longitudinal paddle guide slot 112 that opens to a cylindrical lead screw chamber 114 outside of the passageway 104 and defined by a lead screw housing portion 116 extending fully along the length of one side of the outer housing 102. As shown in FIG. 14, a lead screw 118 is rotatably supported in the chamber 114 and is fixed to a pinion gear 120 (FIG. 12) exposed through the outer housing 102 and driven by the motor powered drive train 48 in a manner to be described. Also, as shown in FIG. 15, the rear end of the lead screw 118, to which the pinion gear 120 is fixed, is supported in a bearing retainer 121 projecting from the rear end of the transfer tube 50 as a locator pin.

As shown in FIGS. 14 and 15, a transfer tube paddle 122 is connected to a running nut 124 on the lead screw 118 by a radial portion 126 that extends through the paddle guide slot 112. As may be seen by a comparison of FIGS. 14 and 15, the paddle 122 travels the length of the transfer tube 50 between an advanced position in FIG. 14 and a retracted position shown in FIG. 15. The paddle guide slot 112 ends short of the front end of the transfer tube 50 so that in the retracted position of the paddle 122, it may swing out of the cylindrical passageway 104.

With reference again to FIGS. 12 and 13, the transfer tube 50 of the illustrated embodiment is provided with three charge unit gripper assemblies 128 which exert a gripping force against the bottom portions of charge units received in the cylindrical passageway 104. The number of gripper assemblies 128 is selected so that each charge unit retained in the transfer tube will be engaged by one such assembly and the selected number will vary with the length of the passageway 104 in the transfer tube and/or with the length of the individual charge units to be handled.

Figure 16:
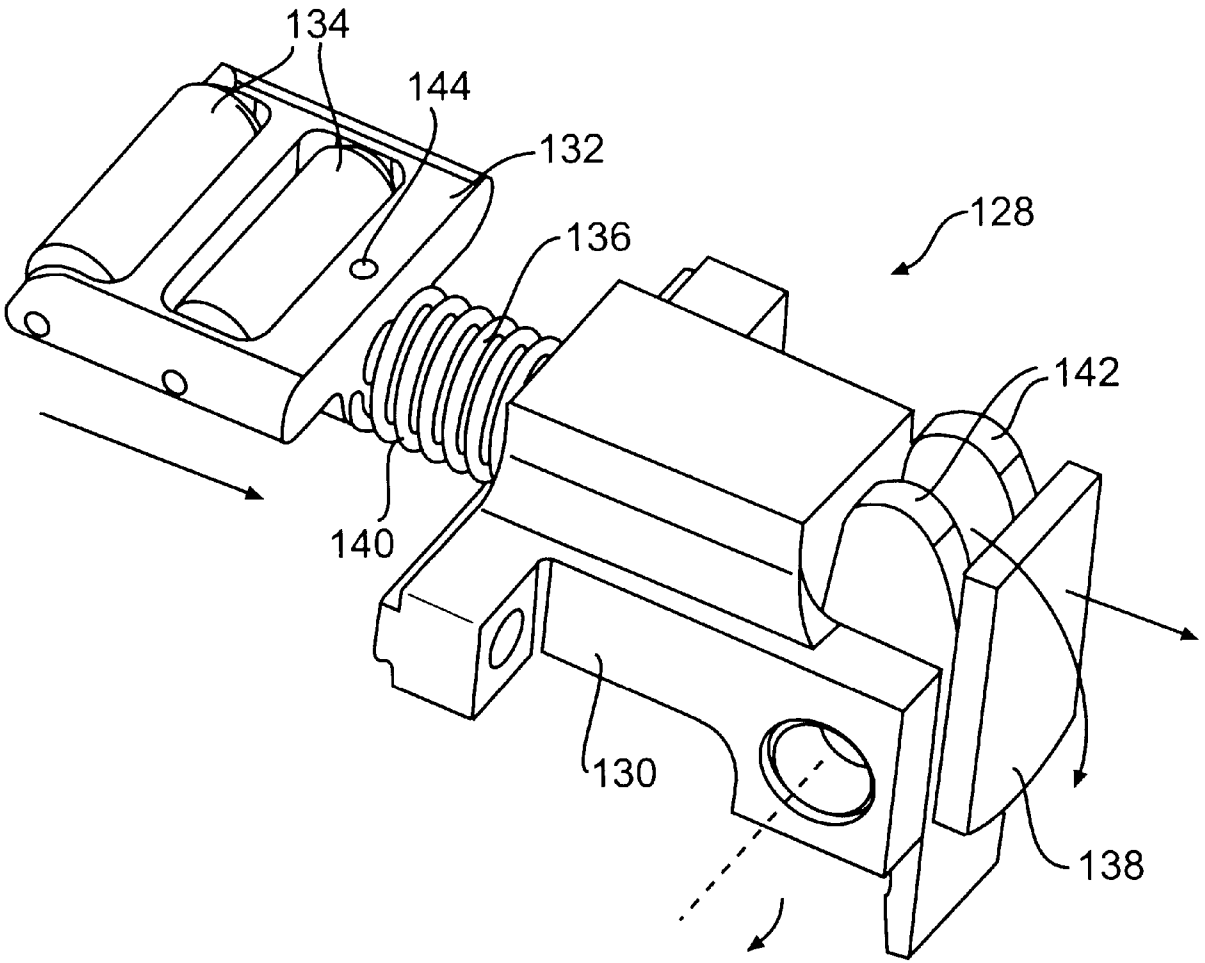
FIG. 16 is a perspective view illustrating a gripper mechanism used in the transfer tube shown in FIGS. 12 and 13.

The construction of each gripper assembly is shown in FIG. 16 to include a housing block 130, a plunger 132 supporting a pair of friction rollers 134, a shaft 136 slidably received in the housing block 130 and having a cam follower plate 138 at one end, a compression spring 140, and a pair of releasing cams 142. The end of the shaft 136 opposite from the plate 138 is fixed by a dowel pin 144 to the plunger 132, and the compression spring 140, concentrically mounted on the shaft 136, exerts a bias between the plunger 132 and the housing block 130 to urge the plunger 132 into a gripping condition from which the plunger 132 is released by the action of the cams 142 against the follower plate 138. As shown in FIG. 12, the cams 142 of all gripper assemblies 128 are keyed to a single control shaft 146 rotatable by a pinion gear 148 in a manner to be described below. It will be apparent at this juncture, however, that the construction of the gripper assemblies 128 limits the force exerted on the charge units U in the transfer tube 50 to the bias force of the springs 140 independently of any other mechanism. Thus, appropriate selection of the springs 140 alone insures that the charge units U will not be subjected to excessive gripping forces.

Figure 18:
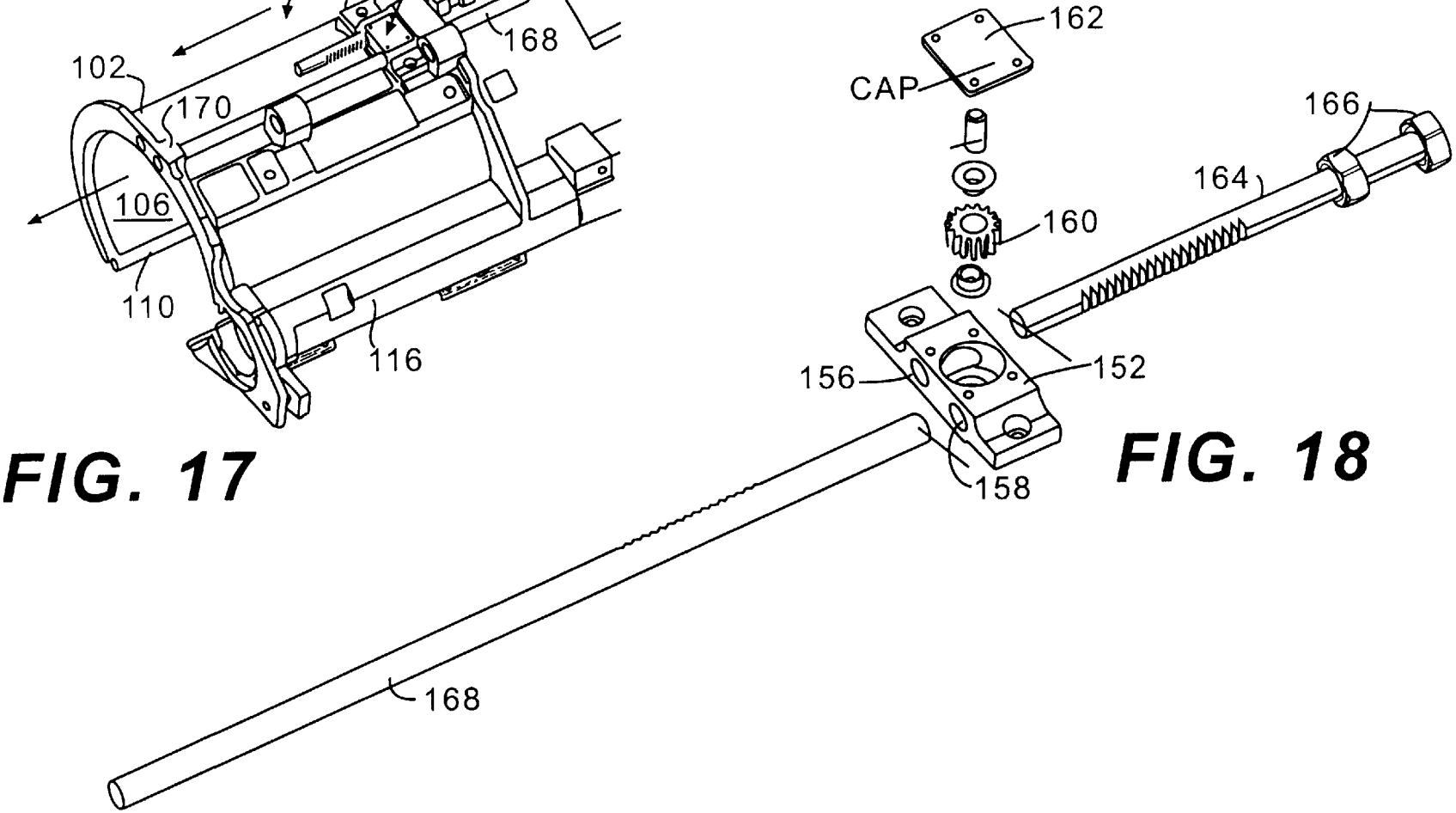
FIG. 18 is an exploded perspective view illustrating components of the device shown in FIG. 17.
Figure 17:
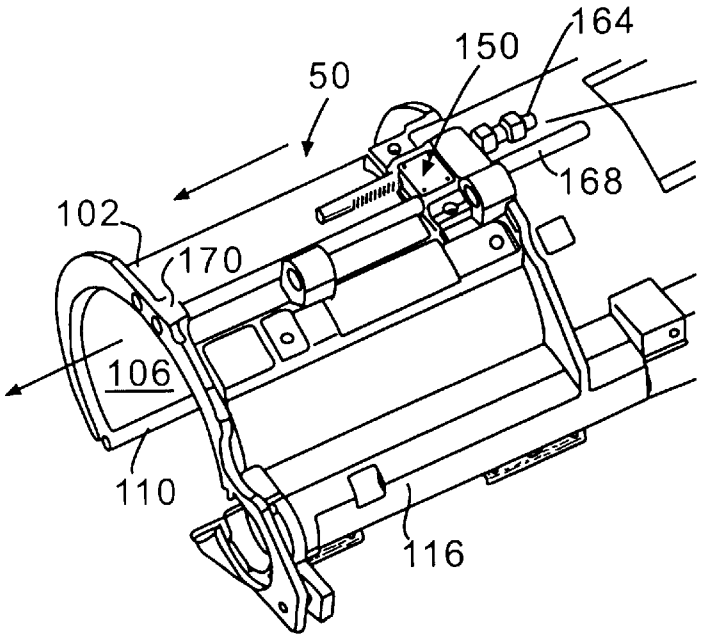
FIG. 17 is the fragmentary perspective view of the transfer tube shown in FIGS. 12 and 13 and depicting a motion multiplier device.
Figure 19:
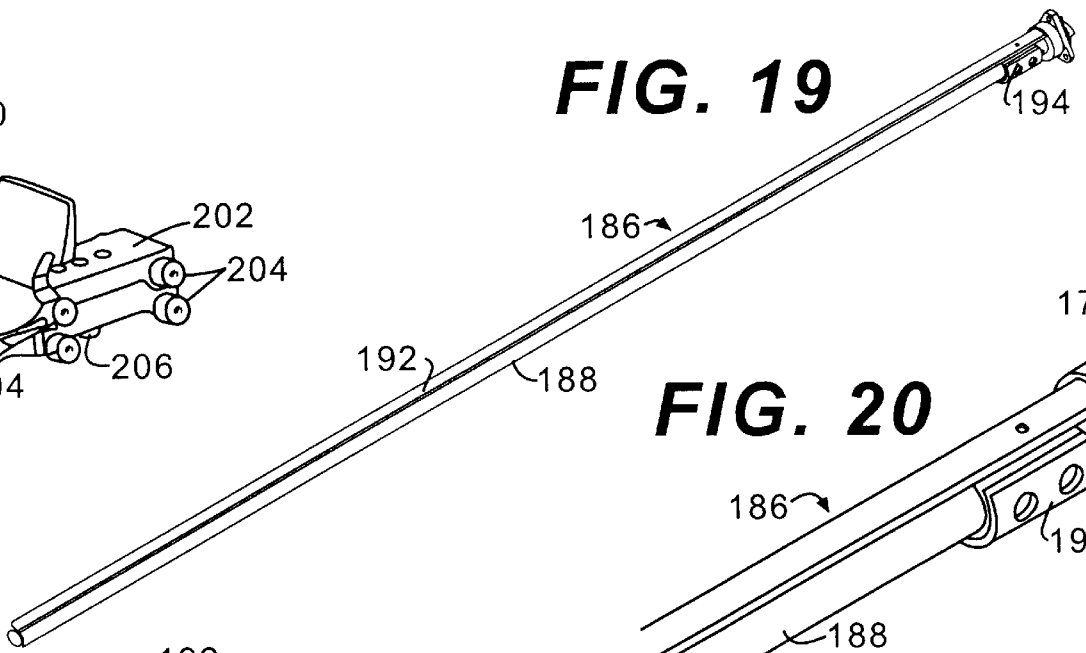
FIG. 19 is a perspective view illustrating a storage chamber lead screw assembly.
Figure 20:
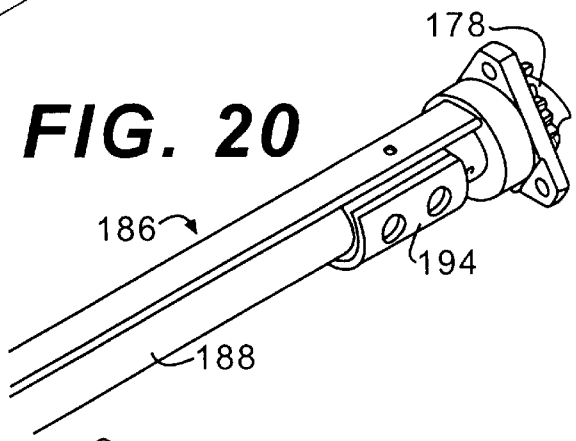
FIG. 20 is an enlarged fragmentary perspective view illustrating one side of the assembly shown in FIG. 19.
Figure 21:
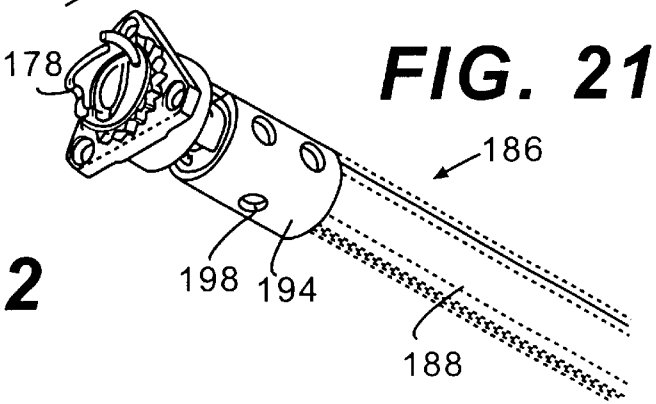
FIG. 21 is a fragmentary perspective view illustrating another side of the assembly shown in FIG. 19.

As shown in FIGS. 17 and 18, the transfer tube 50 supports a motion multiplier device, generally designated by the reference number 150, and which operates to release the previously described frictional restraint 28 associated with each of the storage chambers 18 of the storage magazine 12. The motion multiplier device 150 includes a housing block 152 bolted to the top of the transfer tube 50. The housing block 152 includes a central pinion gear chamber 154 opening on opposite sides to guide holes 156 and 158. As shown in FIG. 18, a pinion gear 160 is rotatably received in the chamber 154 and enclosed by a cap 162. A fixed rack 164 is secured by nuts 166 to the underside of the horizontal support portion 88 of the elevator slide 46 and extends through the guide hole 156 of the housing block 152 to mesh with the pinion gear 160. A movable rack 168 is received in the guide hole 158 to be in mesh with the opposite side of the pinion gear 160 from the fixed rack 164 and extends through a guide bushing 170 at the rear end of the transfer tube as shown in FIG. 17. From the construction of the motion multiplier 150, it will be appreciated by those skilled in the art that movement of the housing block 152 and the pinion gear 160 relative to the fixed rack 164 will result in movement of the movable rack 168 through twice the distance that the transfer tube 50 and the housing block 150 are moved relative to the fixed rack 164.

Figure 11:
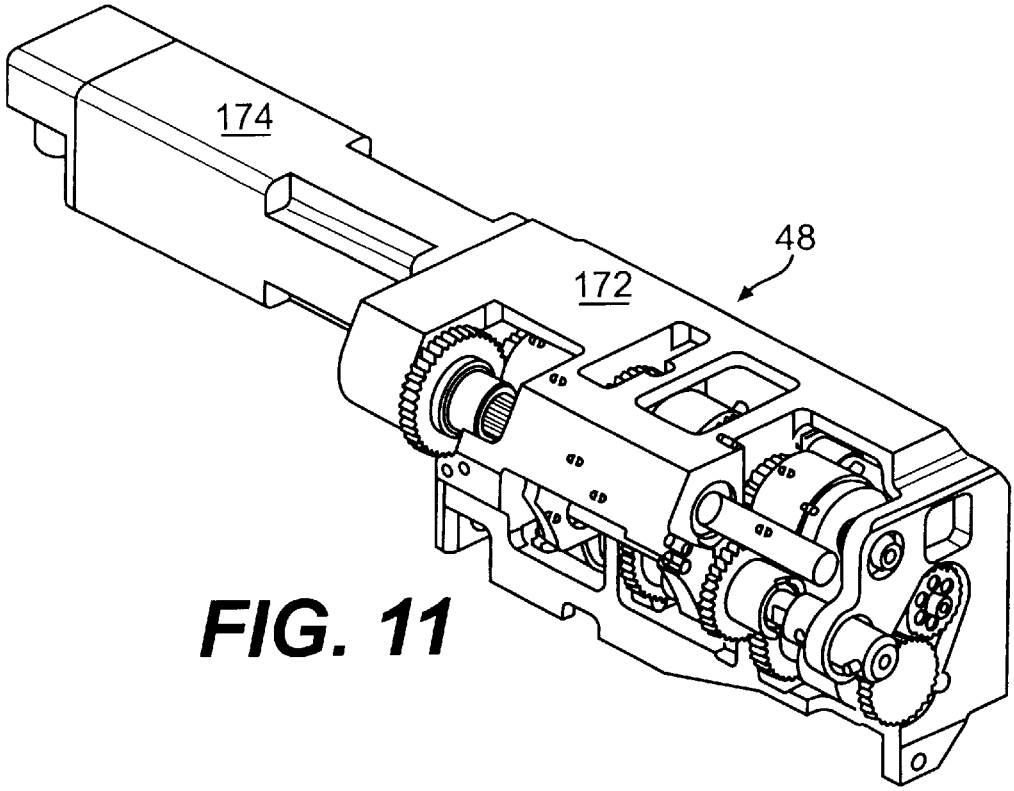
FIG. 11 is a perspective view of a motor power drive train incorporated in the shuttle of FIG. 8.

In FIGS. 8 and 11, the exterior of the motor powered drive train 48, carried by the shuttle 14, is shown to include a housing 172 and an electric motor 174 mounted to the housing. Although many of the components included in the drive train 48 appear in FIGS. 8 and 11, a description of such components and the many functions of the motor powered drive train will be found below with reference to more schematic illustrations.

As described above, the translating motor 66 functions to translate the shuttle 14 along the front of the storage magazine on an X axis only. The motor powered drive train 48 operates to effect driving movement of all operating components supported on the shuttle as well as operating components associated with the storage magazine 12. In this latter respect, and with reference to FIG. 3, each storage chamber 18 in the storage magazine 12 has a pivotal closure gate 176, a coupling 178 connected to a feed screw and storage paddle to be described, a feed screw brake 180, and a pilot hole guide 182. Follower devices (not shown), for opening the closure gate 176 and for releasing the feed screw brake 180 in a manner to be described, extend into the pilot hole guide 182.

Figure 22:
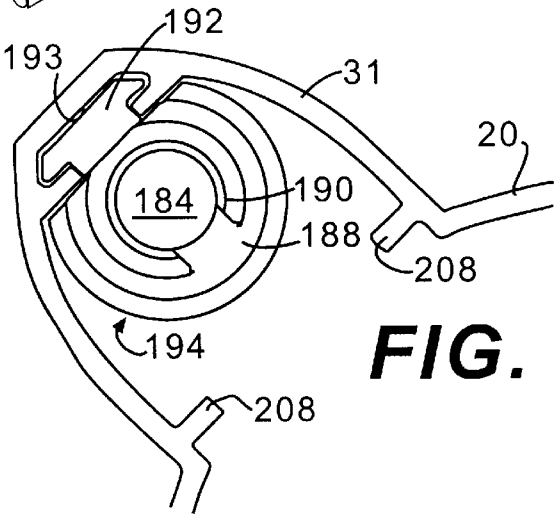
FIG. 22 is an enlarged end view of the assembly shown in FIG. 19.

The coupling 178 for each storage chamber 18 is connected to a storage chamber lead screw 184 incorporated in a lead screw assembly, designated generally by the reference numeral 186 in FIGS. 19–22, and supported within the housing formation 31 illustrated in FIGS. 4 and 22. As shown most clearly in the end view of FIG. 22, the assembly 186 includes a slotted cylindrical support sleeve 188 having an internal bushing 190 to receive the lead screw 184. The support sleeve is riveted to and reinforced by a T-bar 192 shaped to be received in an undercut channel 193 at the outer portion of the housing formation 31. A running nut member 194, having a radial screw segment 196 to mesh with the lead screw 184, has a radial bore 198 opening in a direction opposite to the T-bar 192.

Figure 23:
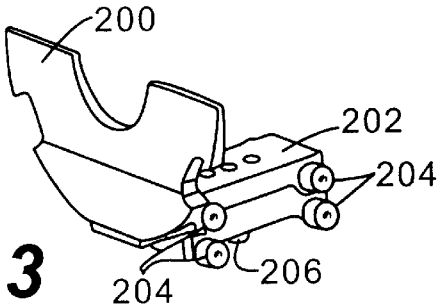
FIG. 23 is a perspective view illustrating a storage chamber paddle driven by the lead screw assembly of FIG. 19.

A storage chamber paddle 200, shown in FIG. 23 is defined in part by a carriage 202 having four sets of two rollers 204. Also the carriage 202 has a projecting pin 206 of a size to fit within the bore 198. In practice, the paddle carriage fits partially within the housing formation 31 with two sets of the rollers 204 riding on opposite sides on each of flange-like tracks 208 extending inwardly at the base of the housing formation 31, and the projecting pin 206 retained securely in the bore 198 of the running nut member 194. In this manner, rotation of the lead screw 184 may drive the paddle 200 lengthwise of the respective storage chamber 18 defined by each tube 20.

In accordance with the present invention, the shuttle carriage is movable in X and Y directions to positions of alignment by the tube of the transfer mechanism with Z axes concentric with the respective storage chambers while all components on the shuttle carriage are spaced in a Z direction from the open ends of the storage chambers. Upon reaching a position of transfer tube alignment with the Z axis of a selected storage chamber, the shuttle carriage is advanced in the Z direction toward the open end of that storage chamber. Also, positioning of the shuttle carriage on the Y axis, the advance and retraction of the shuttle carriage on the Z axis, and the driving of all components needed to effect transfer of storable units between the transfer mechanism and the storage chambers, is effected by the single-motor powered drive train carried by the shuttle carriage.

Figure 24:
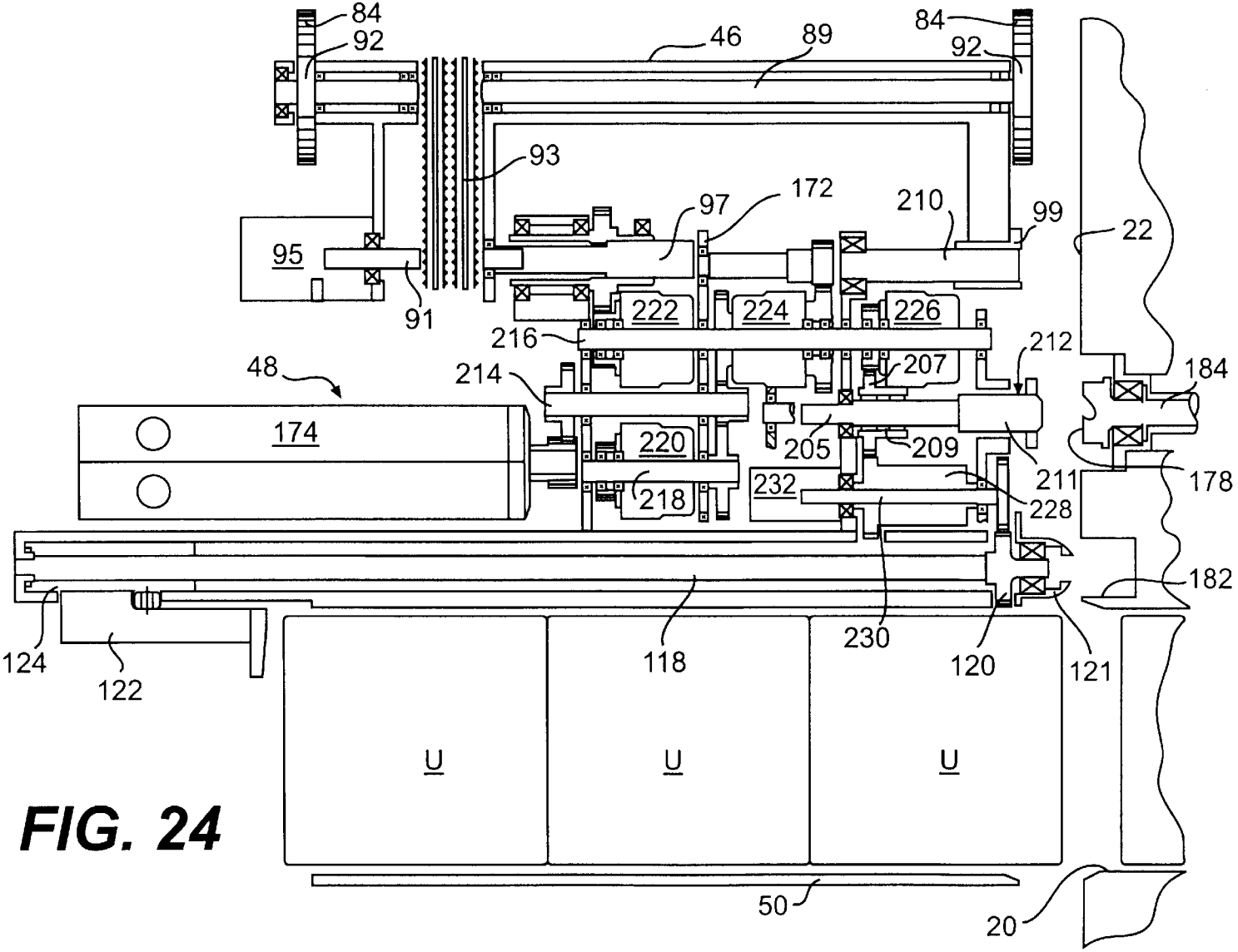
FIG. 24 is a schematic illustration of a shuttle carried motor powered drive train incorporated in the system of FIG. 1.
Figure 25:
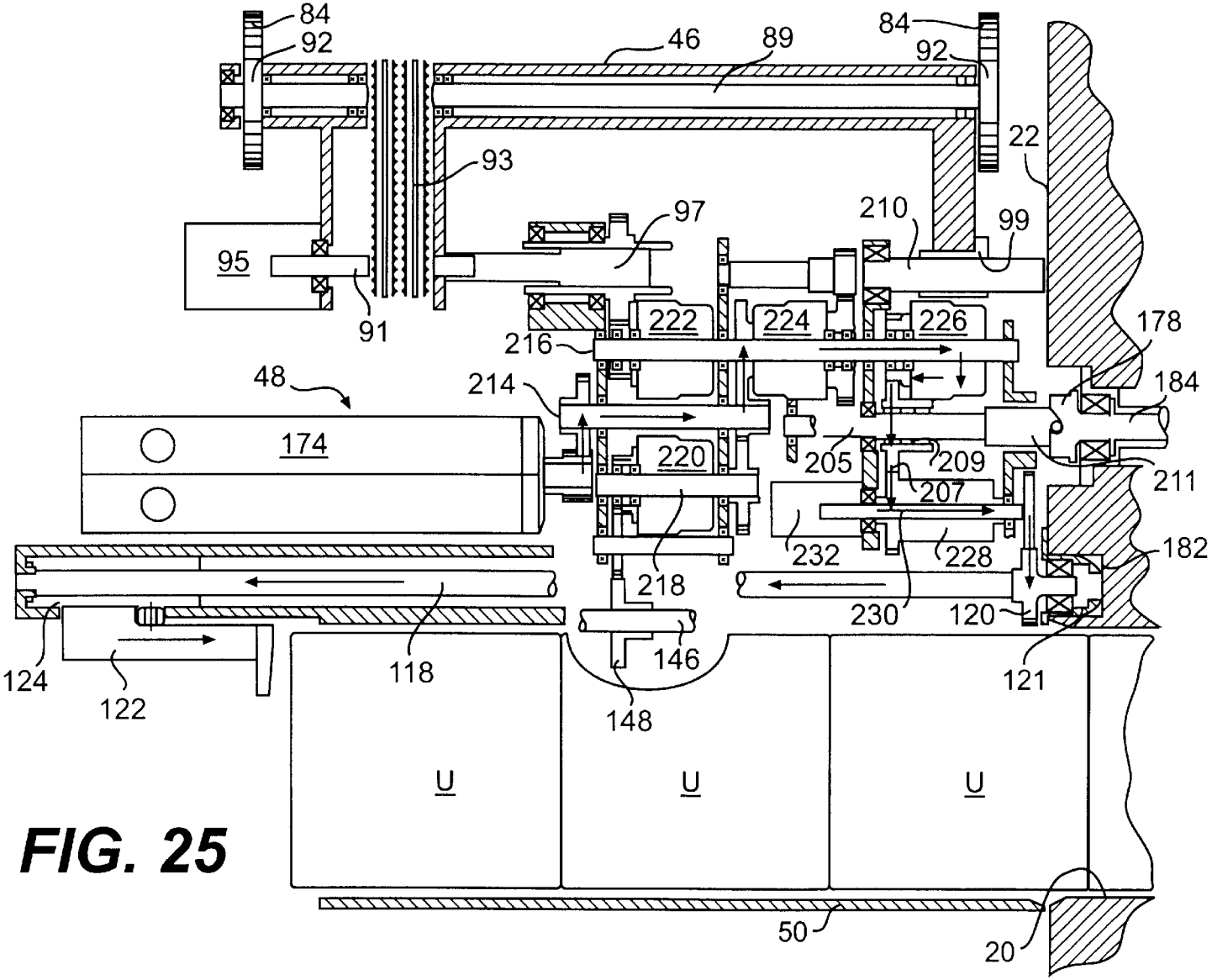
FIG. 25 is a schematic view of the drive train shown in FIG. 24 in one condition of operation.
Figure 26:
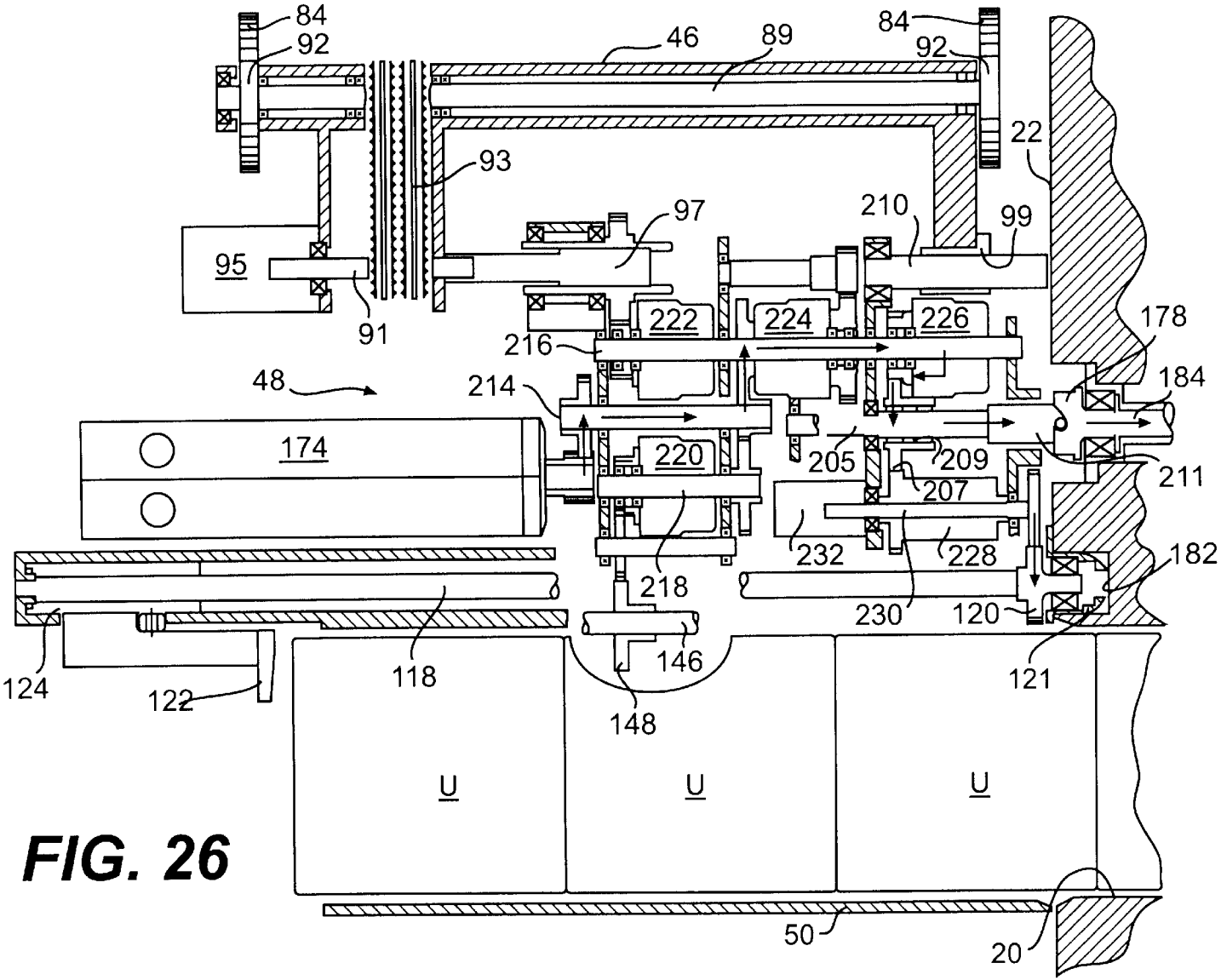
FIG. 26 is a schematic illustration of the motor powered drive train shown in another condition of operation.

In the illustrated embodiment, operating components on the shuttle carriage are shown schematically in FIG. 24 to be spaced from the open ends of the storage chambers 18 and from the front frame member 22. In FIGS. 25 and 26, the same components are similarly shown advanced toward the front frame member 22, and, where applicable, in working engagement with operating components associated with each storage chamber tube 20.

As described above with reference to FIGS. 10–12, the motor powered drive train 48 and transfer tube 50 are supported for limited translating movement in a Z direction on the carriage elevator slide 46. To effect such movement, and as shown in FIG. 24, a Z-axis screw 210 is journalled for rotation in the housing 172 of the drive train housing 48, but held against axial displacement relative to the housing 48. Also, the screw 210 is threadably engaged with the lead screw nut 99 that is fixed to the elevator slide 46. Thus, when the screw 210 is driven in the appropriate direction of rotation, the drive train 48 and transfer tube 50 will move from a retracted position, shown in FIG. 24, to a load/unload position shown in FIGS. 25 and 26. In the course of such movement, the bearing retainer/locator pin 121 of the end of the transfer tube lead screw 118 enters the pilot hole guide 182 for the selected storage tube 20 to precisely align the transfer tube with that storage tube, to open the pivotal closure gate 176, and to release the feed screw brake 180 for that storage tube. In addition, the motion multiplier device 150 (FIGS. 17 and 18) is operated by such movement to disengage the frictional restraint 28 (FIGS. 5–7) from the charge units in the selected storage tube 20. Finally, movement of the drive train 48 and transfer tube 50 to the load/unload position results in engagement of the feed screw coupling 178 for the selected storage tube 20 by a power drive coupling 212 in the drive train housing 172.

Figure 27:
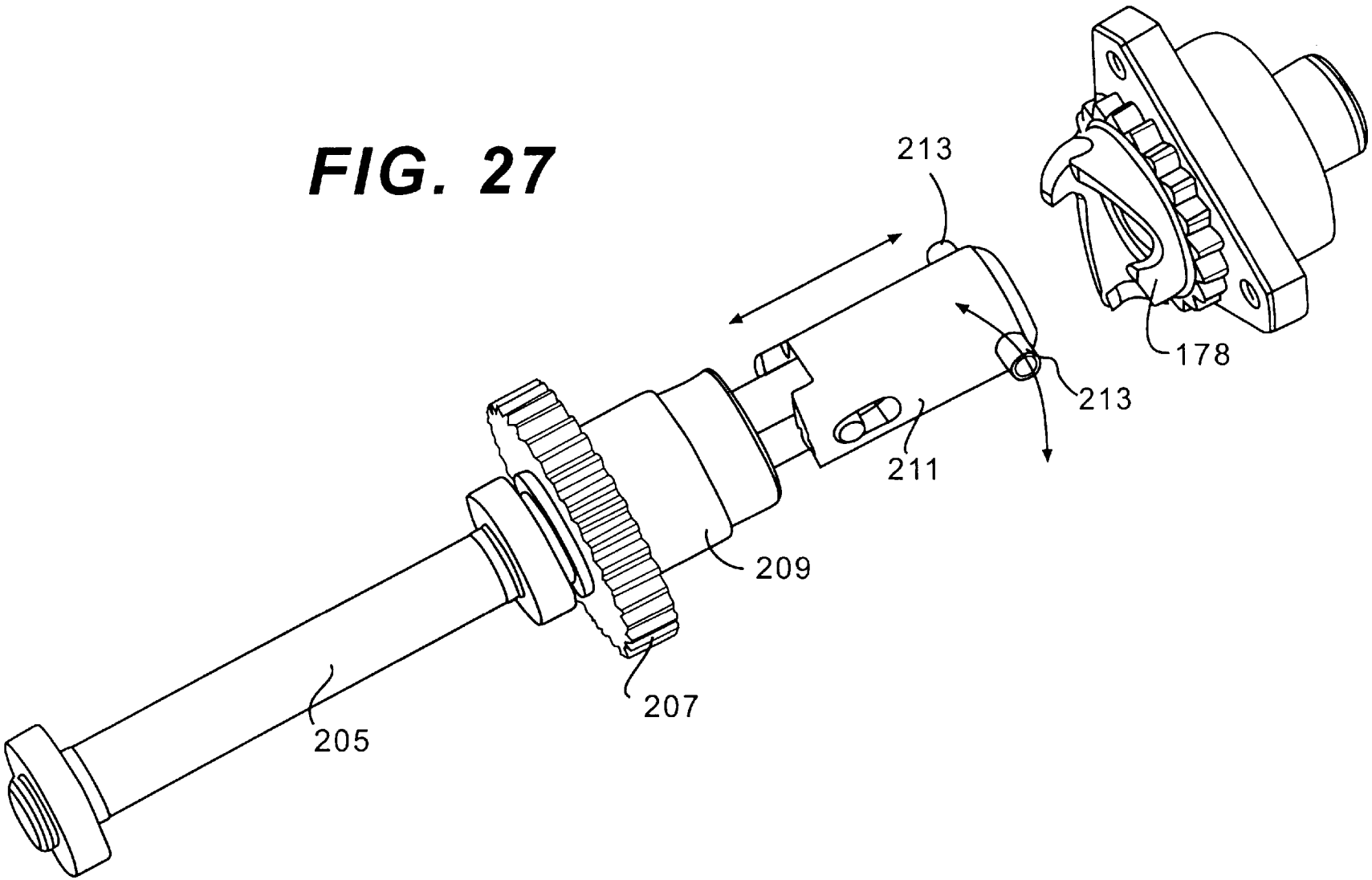
FIG. 27 is a perspective view illustrating a drive shaft and coupling assembly incorporated in the motor powered drive train of FIG. 24.

The power drive coupling 212 is shown in FIG. 27 to include a drive shaft 205 journalled for rotation and retained against axial displacement in the housing 172. A drive gear 207 is fixed to an over-running one-way clutch 209 for supplying torque to the drive shaft 205 in one rotational direction of the drive gear 207 and allowing the drive gear 207 to rotate freely on the drive shaft 205 when rotated in the opposite direction. A drive head 211 having diametric coupling pins 213 is mounted on the end of the drive shaft 205 for limited axial movement under a spring bias while transmitting torque supplied by the drive shaft. Thus tolerances in axial positioning of the gear train housing 172 are accommodated by the power drive coupling 212.

As shown in FIGS. 24–26, the motor 174 of the drive train 48 is coupled by a system of geared counter shafts and clutches with all of the rotatably driven shaft components carried by the elevator slide 46. Those components include Y-axis positioning of the elevator slide 46 via the pinion gears 92 and the racks 84, the Z-axis screw 210, the control shaft 146 (FIG. 12) of the gripper assemblies 128, the paddle driving lead screw 118 of the transfer tube 50, and the power drive coupling for driving the lead screw 184 of each of the storage tubes 20. Thus, the output shaft of the motor 174 is coupled by gearing to a counter shaft 214, in turn coupled by gearing to first and second drive shafts 216 and 218, respectively, both journalled for rotation in the gear train housing 172. The drive shafts 216 and 218 are coupled at all times with the output shaft of the drive motor 174, and are coupled and decoupled to the respective output devices by clutches. In particular, a gripper clutch 220 couples and decouples the second drive shaft 218 with the gripper control shaft; a Y-axis clutch 222 couples and decouples the first drive shaft 216 with the shaft 91 to drive the pinions 92 in mesh with the racks 84; a Z-axis clutch 224 couples and decouples the first drive shaft 216 with the screw 210; and a paddle clutch 226 couples and decouples the first drive shaft 216 with either of the power drive coupling 212 through the one-way clutch 209 for driving the paddle lead screw 184 of each storage tube, or the paddle lead screw 118 of the transfer tube 50 through a one-way clutch 228 in a manner to be described.

In accordance with the present invention, storable units are transferred between the transfer tube and the storage chambers by pushing the storable units under a reactive resistance in both directions of travel.

In the illustrated embodiment, the paddle driving lead screws 118 and 184 associated respectively with the transfer tube 50 and the storage tubes 20 are reversible, that is, driven rotation of each lead screw will move the associated paddle 122 or 200 axially, whereas movement of either paddle under an axial force will result in rotation of the corresponding lead screw. Also, the electric motor 174 in the motor powered drive train 48 is reversible.

Operation of the motor powered drive train 48 to upload charge units U in the transfer tube 50 to the selected storage tube 20 is depicted in FIG. 25 in which the path of power transmitted from the motor 174 is indicated by arrows. During the upload operation, the motor is operated to rotate in a counter clockwise direction, for example, to transmit power through the counter shaft 214 to the first drive shaft 216. The paddle clutch 226 is engaged with the first drive shaft 216 and outputs power to the drive gear 207. Because the over-running one-way clutch 209 is disengaged from and rotates freely on the shaft 205 during counter clockwise rotation of the motor 174, the drive gear 207 acts as an idler gear to transmit power to the one-way clutch, which at this time is engaged with the gear shaft 230 and drives the lead screw 118 to advance the transfer tube paddle 122 against the charge units U and push them into the storage tube 20.

Although the storage chamber paddle 200 is not shown in FIG. 25, it is either initially positioned at the open end of the tube 20, or is in abutting engagement with the most advanced charge unit already in the tube 20 as a result of previous upload and download operations. As the charge units are pushed into the storage tube 20 by the transfer tube paddle 122, the storage tube paddle 200 is moved axially by the uploaded charge units, causing the storage tube lead screw 184 to rotate the coupling shaft 205 in the over running clutch 209. As a result, the charge units are uploaded into the storage tube under a compressive force corresponding to the resistance to axial movement of the storage tube paddle causing the lead screw 184 to rotate.

Operation of the motor powered drive train 48 to download charge units U from the selected storage tube 20 to the transfer tube 50, depicted in FIG. 26, is essentially a reversal of the described upload operation. Thus, to download the charge units, the described motor is operated in a clockwise direction of rotation to transmit power to the paddle clutch 226. During download, however, the over running clutch 209 is engaged and the over running clutch 228 is disengaged. In this condition, power is transmitted from the clutch 209 to the drive shaft 205 of the drive coupling 212 and the storage chamber lead screw 184, to push charge units U in the selected tube 20 into the transfer tube 50. Compressive resistance to the pushed charge units is supplied by axial movement the transfer tube paddle 122 and rotation of the disengaged lead screw 118.

When the desired number of charge units are downloaded into the transfer tube 50, the gripper clutch 220 is momentarily engaged to release the spring biased gripper assemblies 128, and the Z-axis clutch 224 is engaged to withdraw the drive train 48 and the transfer tube 50 to the retracted position shown in FIG. 24. Thereafter, the shuttle is translated to deliver the transfer tube carried charge units to the conveyor 16 or to another storage chamber 19.

Figure 28:
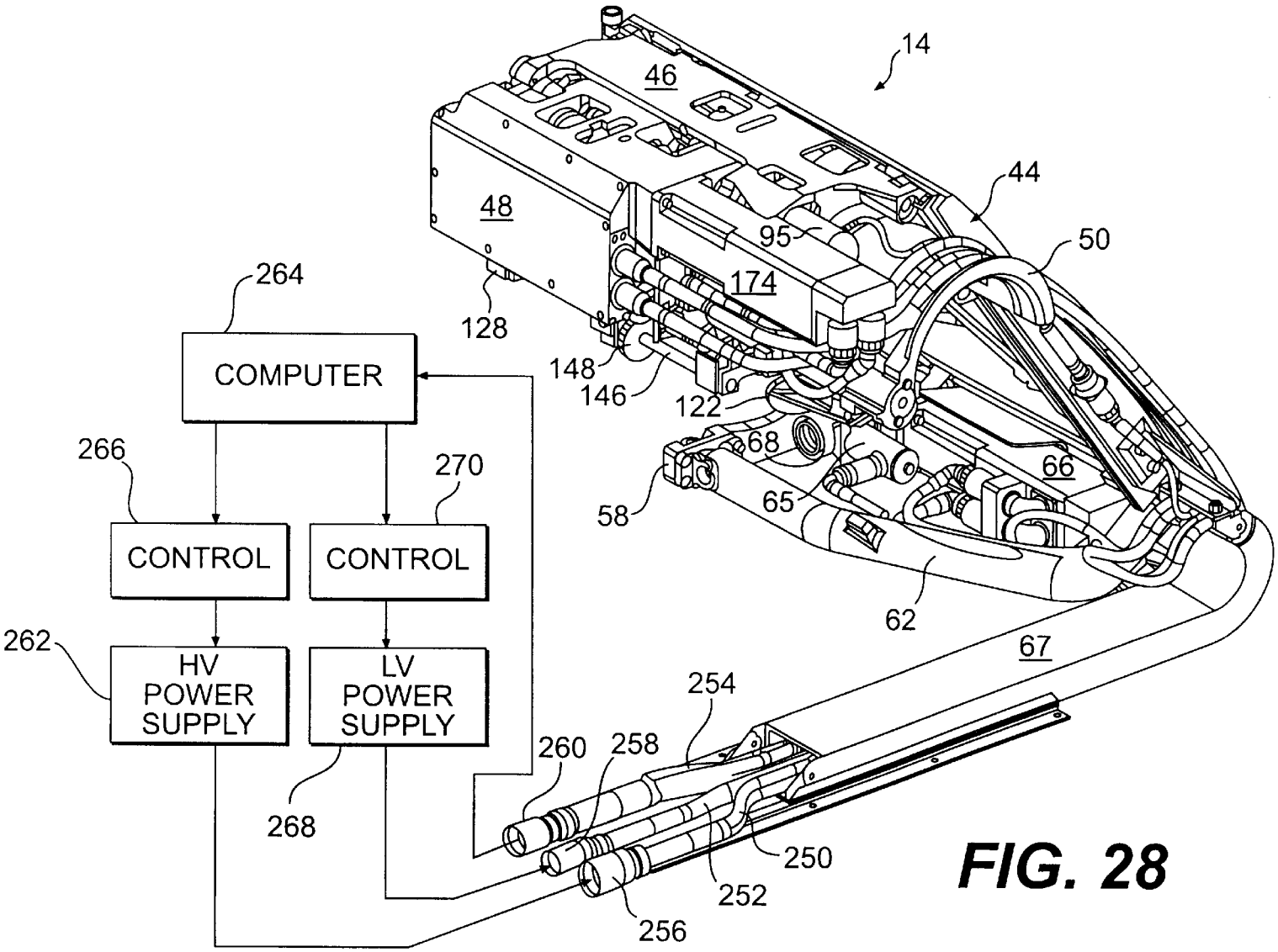
FIG. 28 is a perspective view illustrating the shuttle of the present invention with wire harnesses and control components.
Figure 29:
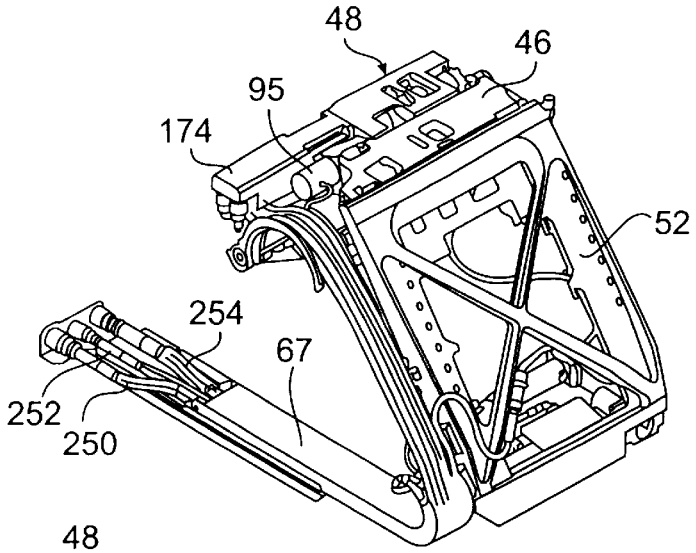
FIG. 29 is a perspective view from the back side of the shuttle and including the wire harness shown in FIG. 28.

In FIG. 28, the shuttle 14 is shown with three wire harnesses 250, 252, and 254 terminating externally of the cable conduit 67 in couplings 256, 258, and 260, respectively. The wire harness 250 is dedicated to high voltage electric power transmission from a high voltage power supply unit 262 to the motors 66 and 174 on the shuttle 14. As depicted in FIG. 28, the high voltage power supply unit 262 is connected to the coupling 256 and controlled by an appropriately programmed computer 264 though a control interface 266. The wire harness 258 supplies low voltage electric power to the clutches 220, 222, 224, 226, and 228 of the motor powered drive train 48, and to the X-axis brake 65, the Y-axis brake 95, and the paddle brake 232, from a low voltage power supply unit 268 controlled by a control interface 270 associated with the computer 264. The wire harness 254 is connected to five position resolvers, to be described below, and inputs component position information to the computer 264.

Position resolvers connected to the wire harness 254 are mounted on the shuttle 14 to monitor: (1) the position of the shuttle 14 on the X-axis; (2) the position of the elevator slide 46 on the Y-axis; (3) the position of the motor powered drive train 48 and transfer tube 50 on the Z-axis; (4) the position of the transfer tube paddle 122 on the Z-axis; and (5) the position of the gripper plungers 132 relative to the transfer tube 50. Each such position resolver is a commercially available device (Part No. 309187 from Transicoil, Inc. of Morristown, Pa., for example) that provides an output signal representing angular displacement of a rotatable element relative to a fixed reference point. Although all of the monitored positions of the shuttle 14 and of the components carried by the shuttle 14 are linear, not angular, the linear position, in each instance, is determined by motion conversion of a rotatable element. Thus, conversion of an output signal representing angular movement of a particular rotatable shaft can be effected, by use of an appropriate algorithm in the computer 264, to provide an indication of linear position of the component driven by that shaft.

Figure 30:
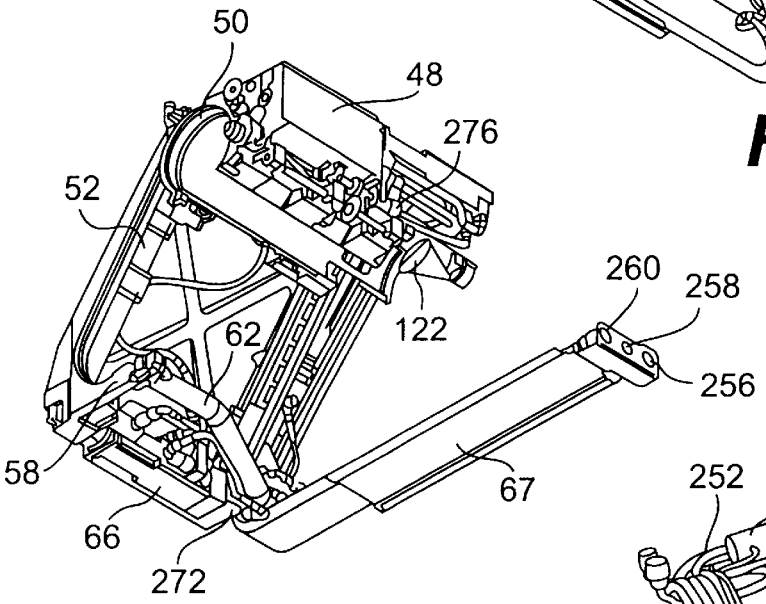
FIG. 30 is a perspective view illustrating the front side of the shuttle mechanism with the wire harness of FIG. 28.
Figure 31:
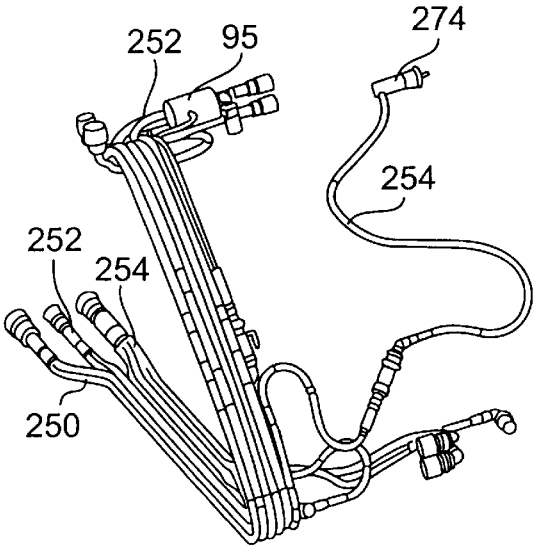
FIG. 31 is a largely schematic perspective view illustrating components of the wire harness as seen in one direction.
Figure 32:
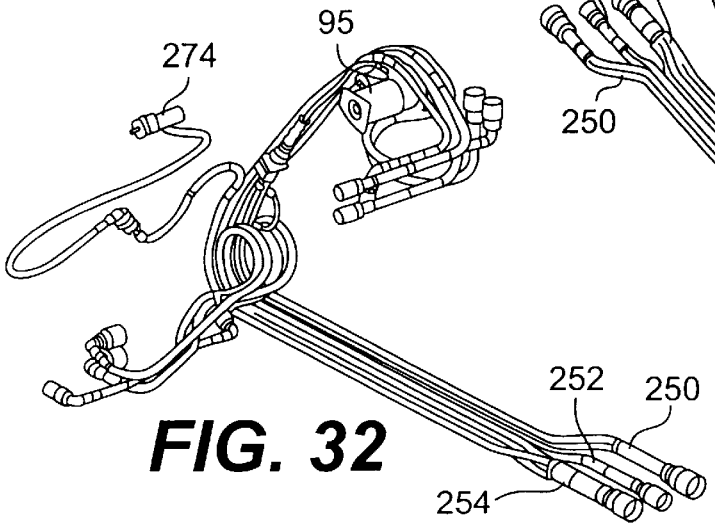
FIG. 32 is a perspective view of the wire harness shown in FIG. 31, but from the opposite side.

In FIG. 30, an X-axis position resolver 272 responds to rotation of the rotatable screw nut 68 (FIGS. 1 and 8)driven by the shuttle translating motor 66. A Y-axis resolver 274, shown in FIGS. 31 and 32, is carried by the elevator slide 46 and responds to rotation of a pinion gear (not shown) in mesh with one of the racks 84 (FIG. 9) on the shuttle frame 52. A gripper position resolver 276 is shown in FIG. 30 as having a gear in mesh with the gear 148 on the gripper control shaft 146.

Figure 33:
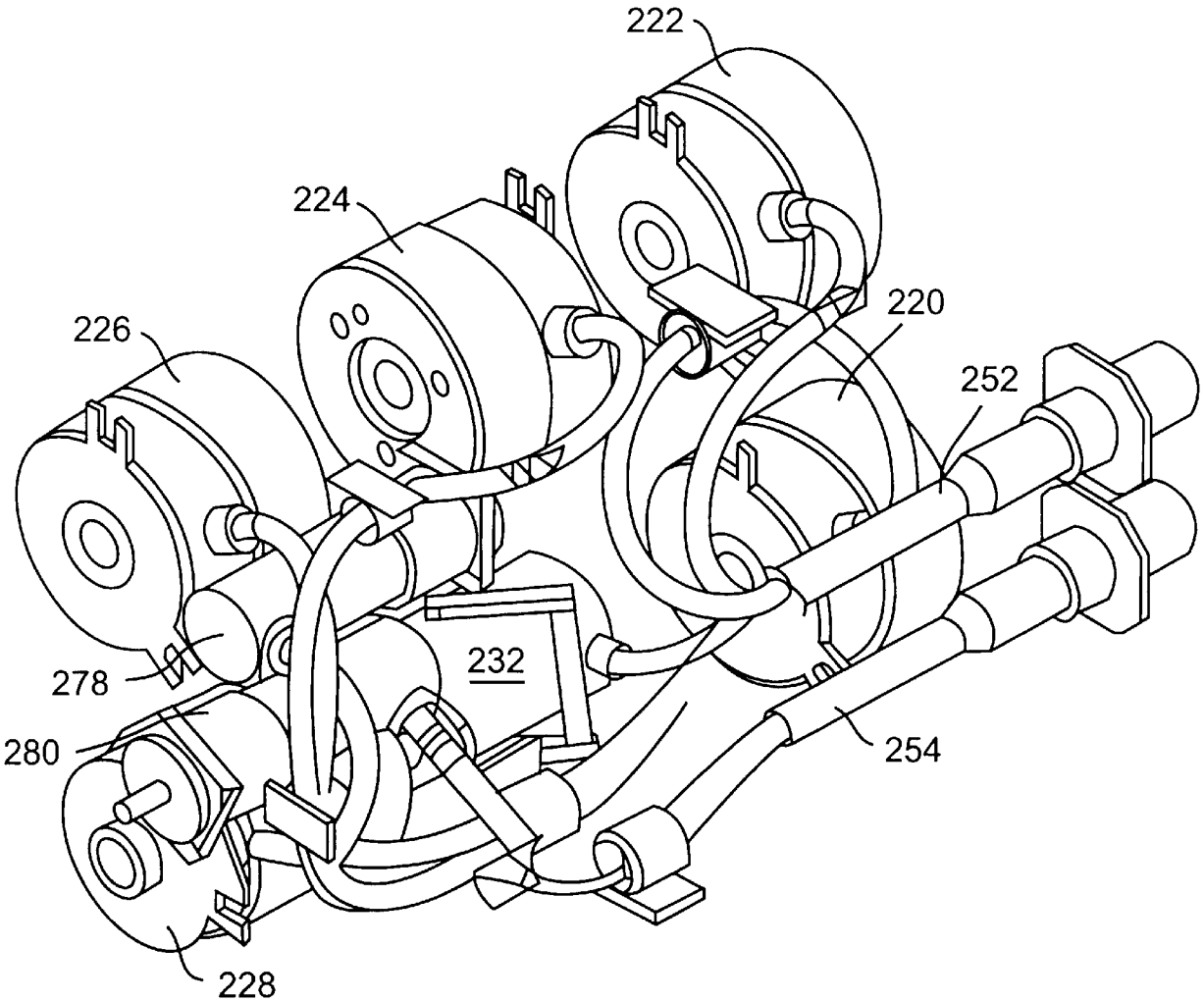
FIG. 33 is a perspective view illustrating wire harness and control components in relation to the clutches incorporated in the motor-powered drive train of the invention.

In FIG. 33, the positions of a Z-axis position resolver 278 and a transfer tube paddle position resolver 280 are shown in relation to clutches described above with reference to FIGS. 24–26. The Z-axis position resolver 278 is connected for rotation with the output of clutch 224 to move the motor powered drive train 48 and transfer tube 50 on the Z-axis, and the transfer tube paddle position resolver 280 is driven by the clutch 228 when the shaft 230 is rotated to drive the paddle lead screw 118 along the Z-axis.

From the foregoing description, it will be appreciated that the current position of the shuttle 14, and thus of the transfer tube 50, on the X-axis, the current position of the transfer tube 50 on the Y-axis, the current position of the drive head 211 and of the transfer tube 50 on the Z-axis, the current position of the paddle 122 relative to the transfer tube 50, and the condition of the gripper assemblies 128, are available to the computer 264 at all times. It will be further appreciated that, given the described operation of the disclosed apparatus and the information made available to the computer 264, full operation of the apparatus under control of the computer 264 is well within the knowledge of those skilled in the computer software art.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. Apparatus for selectively transferring storable units between a storage space and a location outside of the storage space, comprising:

a storage magazine defining the storage space and including a plurality of parallel, axially elongated chambers opening to at least one end of the storage magazine;

a shuttle having a transfer mechanism movable relative to the storage magazine between positions of axial alignment with each of the plurality of elongated chambers and the location outside of the storage space;

a feed mechanism to move the units between the transfer mechanism and the elongated chambers; and a motor and drive train on the shuttle and movable with the transfer mechanism for operating the feed mechanism;

wherein the feed mechanism includes an unloading unit pusher for each of the plurality of axially elongated chambers, and a loading unit pusher on the transfer mechanism.

2. The apparatus of claim 1, wherein each of the unloading unit pusher and the loading unit pusher provide a reactive resistance to the other to retain the units under axial compression during unit loading and unloading.

3. The apparatus of claim 1, wherein the unloading unit pusher for each of the plurality of axially elongated chambers includes a storage paddle extending into the respective chamber and a storage feed screw to drive the storage paddle in a unit-unloading direction and to be rotated freely by axial movement of the storage paddle in a unit-loading direction.

4. The apparatus of claim 3, wherein the transfer mechanism is movable axially toward and from the opening of each of the chambers, and the storage feed screw is coupled and decoupled from the motor and drive train by axial movement of the transfer mechanism.

5. The apparatus of claim 1, including a loading screw on the transfer mechanism to drive the loading unit pusher axially toward the end of the storage magazine in a unit loading direction and to be rotated freely by axial movement of the loading unit pusher in a unit unloading direction.

6. The apparatus of claim 1, wherein the unloading unit pusher for each of the plurality of axially elongated chambers includes a storage paddle extending into the respective chamber and a storage feed screw to drive the storage paddle in a unit unloading direction and to be rotated freely by axial movement of the storage paddle in a unit loading direction, and including a loading screw on the transfer mechanism to drive the loading unit pusher axially toward the end of the storage magazine in a unit loading direction and to be rotated freely by axial movement of the loading unit pusher in a unit unloading direction.

7. The apparatus of claim 6, wherein the transfer mechanism is movable axially toward and from the opening of each of the chambers and the storage feed screw is coupled and decoupled from the motor and drive train by axial movement of the transfer mechanism.

8. Apparatus for selectively transferring storable units between a storage space and a location outside of the storage space, comprising:

a storage magazine defining the storage space and including a plurality of parallel, axially elongated chambers opening to at least one end of the storage magazine;

a shuttle having a transfer mechanism movable relative to the storage magazine between positions of axial alignment with each of the plurality of elongated chambers and the location outside of the storage space; and a feed mechanism to move the units between the transfer mechanism and the elongated chambers, wherein each of the plurality of parallel, axially elongated chambers includes a self-energized friction restraint for preventing movement of units stored in each chamber toward the open end thereof, the self-energized friction restraint including a friction pad extending axially along one side of each chamber, and a cam system for developing a radial normal force on the friction pad in response to an axial force tending to move the stored units toward the open end of the respective chambers.

9. Apparatus for selectively transferring storable units between a storage space and a location outside of the storage space, comprising:

a storage magazine defining the storage space and including a plurality of parallel, axially elongated chambers defined by parallel tubes opening to at least one end of the storage magazine;

a shuttle having a transfer mechanism movable relative to the storage magazine between positions of axial alignment with each of the plurality of elongated chambers and the location outside of the storage space; and a feed mechanism to move the units between the transfer mechanism and the elongated chambers, wherein the cylindrical tubes extend on Z axes and have open ends at which the respective Z axes intersect with X and Y axes perpendicular to the Z axes, the X and Y axes intersecting with each other at an acute angle in the range of from 50° to 60°.

10. The apparatus of claim 9, wherein the shuttle is translatable on an X axis and the transfer mechanism is movable on a Y axis.

11. The apparatus of claim 10, including a conveyor operable the Z axis to deliver storable units to and from the storage magazine and positioned for transfer of units to and from the transfer mechanism.

12. Apparatus for selectively transferring storable units between a storage space and a location outside of the storage space, comprising:

a storage magazine defining the storage space and including a plurality of parallel, axially elongated chambers opening to at least one end of the storage magazine;

an unloading mechanism associated with each of the parallel, axially elongated chambers and including a rotatable unloading feed screw having a drive coupling presented at the at least one end of the storage magazine;

a shuttle having a transfer mechanism movable relative to the storage magazine between positions of axial alignment with each of the plurality of elongated chambers and the location outside of the storage space, the transfer mechanism including a rotatable loading feed screw; and a feed mechanism on the shuttle to move the units between the transfer mechanism and the elongated chambers, the feed mechanism including a single reversible motor and a drive train carried by and movable with the transfer mechanism.

13. The apparatus of claim 12, wherein the drive train includes a drive shaft coupled at all times to the reversible motor for rotation thereby, first and second driven shafts for connection to the unloading and loading screws, respectively, and clutch means for coupling one of the first and second driven shafts to the drive shaft in dependence on rotational direction of the reversible motor.

14. The apparatus of claim 13, wherein the clutch means includes a one-way clutch on the first driven shaft to couple the first driven shaft to the unloading screw to the reversible motor during unloading of the associated one of the storage magazine chambers, and to allow rotation of the unloading screw under an axial force during loading of the associated one of the storage magazine chambers.

15. The apparatus of claim 14, wherein the transfer mechanism is movable on the shuttle along a first axis perpendicular to the axially elongated chambers and along a second axis parallel to the axially elongated chambers, and wherein the drive train includes third and fourth driven shafts coupled respectively by clutches to the drive shaft to move the transfer mechanism along the respective first and second axes.

16. The apparatus of claim 15, including a releasable brake for selectively holding the third driven shaft against rotation.

17. The apparatus of claim 15, wherein the transfer mechanism includes gripper means for retaining the storable units and the drive train includes a fifth driven shaft coupled by clutch means to the drive shaft for operating the gripper means.

18. A system for storing and handling artillery propellant charge units, comprising:

a storage magazine including a plurality of parallel, cylindrical tubes defining elongated chambers on Z axes and having open ends presented on X and Y axes at one end of the storage magazine, the X and Y axes being perpendicular to the Z axes;

a shuttle translatable on the X axis along the one end of the storage magazine and supporting a transfer tube parallel to the cylindrical tubes and movable on a Y axis relative to the storage magazine so that a combination of shuttle translation on the X axis and movement of the transfer tube on the Y axis positions the transfer tube in axial alignment with the respective open ends of each of the plurality of cylindrical tubes; and a feed mechanism to move the charge units on the Z axes between the respective elongated chambers and the transfer tube.

19. The system of claim 18 including a conveyor operable the Z axis to deliver charge units to and from the storage magazine and positioned for transfer of charge units to and from the transfer tube.

20. The system of claim 18 including position resolvers to monitor the positions of the transfer tube on the X and Y axes, and of the feed mechanism on the Z-axis.

21. A method for storing artillery charge units in a storage magazine including sides defined by a plurality of parallel, elongated, cylindrical chambers respectively centered on Z axes and having open ends presented on intersecting X and Y axes at one end of the storage magazine, the X and Y axes being perpendicular to the Z axes, using a shuttle translatable on an X axis along the one end of the storage magazine and supporting a transfer tube parallel to Z axes and movable on a Y axis, the method comprising the steps of:

loading the charge units into the transfer tube on one side of the magazine;

translating the shuttle on the X axis to a position of registration with an X axis of one of the storage chambers;

moving the transfer tube on the Y axis to a position of registration with the Z axis of the one of the storage chambers; and advancing the charge units along the Z axis of and into the one of the storage chambers.

* * * * *